US010358270B1

(12) United States Patent
McCready et al.

(10) Patent No.: US 10,358,270 B1
(45) Date of Patent: Jul. 23, 2019

(54) CLOSURE ASSEMBLIES AND DRINK CONTAINERS INCLUDING THE SAME

(71) Applicant: CamelBak Products, LLC, Petaluma, CA (US)

(72) Inventors: Aaron J. McCready, Tahoe City, CA (US); Jeff Davies, Windsor, CA (US)

(73) Assignee: CamelBak Products, LLC, Petaluma, CA (US)

( * ) Notice: Subject to any disclaimer, the term of this patent is extended or adjusted under 35 U.S.C. 154(b) by 0 days.

(21) Appl. No.: 15/994,336

(22) Filed: May 31, 2018

(51) Int. Cl.
*B65D 47/20* (2006.01)
*B65D 41/04* (2006.01)
*A45F 3/16* (2006.01)

(52) U.S. Cl.
CPC ..... *B65D 47/2031* (2013.01); *A45F 3/16* (2013.01); *B65D 41/04* (2013.01)

(58) Field of Classification Search
CPC .. B65D 41/04; B65D 47/2031; B65D 41/247; B65D 47/243; A45F 3/16
USPC ..... 222/494
See application file for complete search history.

(56) References Cited

U.S. PATENT DOCUMENTS

| | | | |
|---|---|---|---|
| 1,475,439 | A | 11/1923 | Lamassiaude |
| 1,673,446 | A | 6/1928 | Eveleth |
| 1,788,795 | A | 1/1931 | Hoban |
| 2,024,065 | A | 12/1935 | Schellens |
| 2,051,440 | A | 8/1936 | Eicken |
| 2,338,604 | A | 1/1944 | Silveyra |
| 2,591,578 | A | 4/1952 | McNealy et al. |
| 2,643,021 | A | 6/1953 | Freedman |
| 2,670,501 | A | 3/1954 | Michiels |
| 2,805,561 | A | 9/1957 | Emmert et al. |
| 2,844,267 | A | 7/1958 | Petriccione |

(Continued)

FOREIGN PATENT DOCUMENTS

| | | | |
|---|---|---|---|
| CN | 85106703 | A | 5/1986 |
| CN | 1198083 | A | 11/1998 |

(Continued)

OTHER PUBLICATIONS

English-language machine translation of French Patent No. FR 1397859 A, Global Patent Solutions, May 22, 2017.

(Continued)

*Primary Examiner* — Vishal Pancholi
(74) *Attorney, Agent, or Firm* — DASCENZO Intellectual Property Law, P.C.

(57) ABSTRACT

Closure assemblies and drink containers including the same. A drink container includes a liquid vessel and a closure assembly. A closure assembly includes a closure base, a valve insert, and a valve insert retainer. The closure base defines a base interior side, a base exterior side, and a closure base passage. The valve insert is operatively received within the closure base passage and includes a liquid inlet and a liquid outlet. The valve insert is configured to transition the closure assembly between a closed configuration and a drink configuration. The valve insert retainer is configured to prevent removal of the valve insert from the closure base when operatively coupled to the valve insert. The valve insert is configured to be selectively and repeatedly received by and removed from the closure base passage only when the valve insert retainer is selectively removed from the valve insert.

35 Claims, 8 Drawing Sheets

(56) References Cited

U.S. PATENT DOCUMENTS 2,936,934 A 5/1960 Kubiliunas
2,981,430 A 4/1961 Tsien et al.
2,987,212 A 6/1961 Scanlon
3,007,596 A 11/1961 Matsch
3,039,648 A 6/1962 Busch
3,079,027 A 2/1963 Edwards
3,096,897 A 7/1963 Edwards
3,113,831 A 12/1963 Coale
3,119,543 A 1/1964 Walker
3,149,742 A 9/1964 Hay et al.
3,152,729 A 10/1964 Piker
3,164,148 A 1/1965 Tolciss
3,179,301 A 4/1965 Lucht
3,181,743 A 5/1965 Libit et al.
3,214,830 A 11/1965 Piker
3,283,967 A 11/1966 Akers
3,294,293 A 12/1966 Johns
3,392,887 A 7/1968 Bross
3,443,715 A 5/1969 Edwards
3,450,254 A 6/1969 Miles
3,456,860 A 7/1969 Janninck
3,484,011 A 12/1969 Greenhalgh et al.
3,655,502 A 4/1972 Yoshikawa
3,720,558 A 3/1973 Menzies et al.
3,739,938 A 6/1973 Paz
3,760,972 A 9/1973 McKiman
3,840,153 A 10/1974 Devlin
3,871,555 A 3/1975 Collins
3,972,443 A 8/1976 Albert
4,055,268 A 10/1977 Barthel
4,090,650 A 5/1978 Gotta
4,196,721 A 4/1980 Posnansky
4,196,817 A 4/1980 Moser
4,212,408 A 7/1980 Valenzona
4,330,066 A 5/1982 Berliner
4,485,963 A 12/1984 Panicci
4,489,473 A 12/1984 Nakagami
4,531,655 A 7/1985 Putnam
4,548,348 A 10/1985 Clements
4,549,410 A 10/1985 Russell
4,581,804 A 4/1986 McLaughlin
4,607,755 A 8/1986 Andreozzi
4,625,884 A 12/1986 Zimmermann
4,629,098 A 12/1986 Eger
4,635,814 A 1/1987 Jones
4,667,881 A 5/1987 Michelotti
4,705,085 A 11/1987 Brown
4,708,254 A 11/1987 Byrns
4,741,936 A 5/1988 Nohara et al.
4,809,484 A 3/1989 Lovik
4,836,404 A 6/1989 Coy
4,852,762 A 8/1989 Coy
4,860,934 A 8/1989 Komischke
4,871,597 A 10/1989 Hobson
4,925,042 A 5/1990 Chong
4,967,941 A * 11/1990 Beck ..... B65D 47/242
215/256
4,993,580 A 2/1991 Smith
4,997,661 A 3/1991 Kromer et al.
5,060,833 A 10/1991 Edison et al.
5,065,909 A 11/1991 Pino et al.
5,085,336 A 2/1992 Lynd
5,085,349 A 2/1992 Fawcett
5,094,363 A 3/1992 Monahan et al.
5,101,991 A 4/1992 Morifuji et al.
5,121,856 A 6/1992 Weiler et al.
5,150,815 A 9/1992 Saklad
5,188,787 A 2/1993 King et al.
5,203,468 A 4/1993 Hsu
5,221,016 A 6/1993 Karpal
5,242,079 A 9/1993 Stephens et al.
5,273,172 A 12/1993 Rossbach et al.
5,301,858 A 4/1994 Hollander
5,307,950 A 5/1994 Li
5,316,193 A 5/1994 Heiberger
5,332,131 A 7/1994 Pehr
5,392,968 A 2/1995 Dark
5,433,353 A 7/1995 Flinn
5,433,535 A 7/1995 Hah
5,439,143 A 8/1995 Brown et al.
5,465,866 A 11/1995 Belcastro
5,472,120 A 12/1995 Stebick et al.
5,494,198 A 2/1996 Heiberger
5,518,142 A 5/1996 Lin
5,520,304 A 5/1996 Lin
5,529,217 A 6/1996 Siegel
5,553,726 A 9/1996 Park
5,567,377 A 10/1996 Nishigami et al.
5,582,315 A 12/1996 Reid
5,601,207 A 2/1997 Paczonay
5,607,087 A 3/1997 Wery et al.
5,699,933 A 12/1997 Ho et al.
D390,462 S 2/1998 Mao
5,730,336 A 3/1998 Lerner
5,755,368 A 5/1998 Bekkedahl
5,791,510 A 8/1998 Paczonay
5,806,726 A 9/1998 Ho
5,873,478 A 2/1999 Sullivan et al.
5,884,793 A 3/1999 Wang
5,897,013 A 4/1999 Manganiello
5,901,882 A 5/1999 Siegel
5,906,300 A 5/1999 Horie
5,911,406 A 6/1999 Winefordner et al.
5,944,234 A 8/1999 Lampe et al.
6,006,952 A 12/1999 Lucas
6,021,801 A 2/2000 Sheppard
6,032,831 A 3/2000 Gardner et al.
6,041,982 A 3/2000 Cautereels et al.
6,050,433 A 4/2000 Russell et al.
6,050,445 A 4/2000 Manganiello
6,059,154 A 5/2000 Bigotte et al.
6,070,767 A 6/2000 Gardner et al.
6,095,382 A 8/2000 Gross
6,116,458 A 9/2000 Dark
6,141,941 A 11/2000 Carroll
6,164,469 A 12/2000 Sartore
6,196,413 B1 3/2001 Tung
6,199,729 B1 3/2001 Drzymkowski
6,212,959 B1 4/2001 Perkins
6,264,166 B1 7/2001 Bowland et al.
6,276,560 B1 8/2001 Belcastro
6,279,772 B1 8/2001 Bowman
6,279,773 B1 8/2001 Kiyota
6,283,344 B1 9/2001 Bradley
6,290,108 B1 9/2001 Gross
6,337,052 B1 1/2002 Rosenwasser
6,364,168 B1 4/2002 Gardner et al.
6,390,341 B1 5/2002 Ohmi et al.
6,422,415 B1 7/2002 Manganiello
6,446,844 B1 9/2002 Gross
6,474,499 B2 11/2002 Donelson et al.
6,474,515 B1 11/2002 Ladina et al.
6,497,348 B2 12/2002 Forsman
6,513,686 B1 2/2003 Ben-Sasson
6,523,711 B1 2/2003 Hughes et al.
6,537,244 B2 3/2003 Paukovits et al.
6,557,721 B2 5/2003 Yang
6,607,092 B2 8/2003 Manganiello et al.
6,609,624 B2 8/2003 Goto et al.
6,631,819 B1 10/2003 Diak/Ghanem
6,675,998 B2 1/2004 Forsman et al.
6,698,716 B2 3/2004 Yang
6,708,950 B2 3/2004 Christensen et al.
6,719,273 B1 4/2004 Yang
D489,978 S 5/2004 Brown
6,742,681 B1 6/2004 Yang
6,745,915 B2 6/2004 Rees
6,752,779 B2 6/2004 Paukovits et al.
6,764,064 B2 7/2004 Sturm et al.
6,783,115 B1 8/2004 Yang
6,854,888 B1 2/2005 Brown et al.
6,908,015 B2 6/2005 Choi et al.
6,915,961 B2 7/2005 Renz et al.
6,938,800 B1 9/2005 Lehmkuhl

(56) References Cited

U.S. PATENT DOCUMENTS

| | | | | |
|---|---|---|---|---|
| 6,951,295 | B1 | 10/2005 | Gaus et al. | |
| 6,994,225 | B2 | 2/2006 | Hakim | |
| 7,014,077 | B2 | 3/2006 | Brown | |
| 7,032,764 | B2 | 4/2006 | Viggiano | |
| 7,048,137 | B2 | 5/2006 | Leoncavallo et al. | |
| 7,059,490 | B2 | 6/2006 | Son | |
| 7,073,688 | B2 | 7/2006 | Choi et al. | |
| 7,143,911 | B2 | 12/2006 | Stoneberg et al. | |
| D547,606 | S | 7/2007 | Forsman | |
| D547,607 | S | 7/2007 | Forsman | |
| 7,243,860 | B2 | 7/2007 | Junkel et al. | |
| 7,261,226 | B2 | 8/2007 | Adams et al. | |
| 7,270,244 | B1 | 9/2007 | Liu | |
| D565,877 | S | 4/2008 | Chen | |
| 7,533,783 | B2 | 5/2009 | Choi et al. | |
| 7,651,003 | B2 | 1/2010 | Albers et al. | |
| 7,686,194 | B2 * | 3/2010 | Kasting | B65D 47/24 215/330 |
| 7,690,524 | B2 | 4/2010 | Chau | |
| 7,753,234 | B1 | 7/2010 | Heiberger | |
| D657,194 | S | 4/2012 | McIntire et al. | |
| 8,191,727 | B2 | 6/2012 | Davies et al. | |
| 8,252,224 | B2 | 8/2012 | Blain | |
| D690,162 | S | 9/2013 | Staton | |
| D691,420 | S | 10/2013 | McIntire | |
| 8,578,133 | B2 | 11/2013 | Archer et al. | |
| 8,636,166 | B2 | 1/2014 | Lane | |
| 8,646,663 | B2 * | 2/2014 | Heiberger | B65D 47/243 222/153.09 |
| 8,662,419 | B2 | 3/2014 | Chang | |
| 8,668,106 | B1 | 3/2014 | Joy et al. | |
| 8,701,928 | B2 | 4/2014 | Samson | |
| 8,777,048 | B2 | 7/2014 | Choi et al. | |
| D719,827 | S | 12/2014 | Duran et al. | |
| 8,905,252 | B2 | 12/2014 | Latham et al. | |
| 9,027,769 | B2 | 5/2015 | Willows et al. | |
| 9,211,557 | B2 | 12/2015 | Syson et al. | |
| 9,386,869 | B2 | 7/2016 | Kamping et al. | |
| 9,434,516 | B2 | 9/2016 | Johnson | |
| 9,522,769 | B2 | 12/2016 | Itzek et al. | |
| 9,527,635 | B2 | 12/2016 | Metz | |
| 9,694,953 | B2 | 7/2017 | Meyers et al. | |
| 9,708,107 | B2 | 7/2017 | El-Saden et al. | |
| 9,745,110 | B2 | 8/2017 | Boyer et al. | |
| 9,776,777 | B2 | 10/2017 | Gorbold | |
| 10,023,365 | B2 | 7/2018 | Choi et al. | |
| 2002/0033399 | A1 | 3/2002 | Manganiello et al. | |
| 2002/0092858 | A1 | 7/2002 | Bowman | |
| 2002/0092877 | A1 | 7/2002 | Bowman | |
| 2002/0148806 | A1 | 10/2002 | Cheng | |
| 2002/0166990 | A1 | 11/2002 | Yang | |
| 2002/0185495 | A1 | 12/2002 | Manganiello | |
| 2003/0085232 | A1 | 5/2003 | Leinenweber | |
| 2003/0102318 | A1 | 6/2003 | Lee | |
| 2003/0116573 | A1 | 6/2003 | Clark et al. | |
| 2003/0168462 | A1 | 9/2003 | Kiyota | |
| 2003/0173536 | A1 | 9/2003 | Christensen et al. | |
| 2003/0218015 | A1 | 11/2003 | Randolph et al. | |
| 2003/0222238 | A1 | 12/2003 | Getzewich et al. | |
| 2004/0000551 | A1 | 1/2004 | Flink et al. | |
| 2004/0069783 | A1 | 4/2004 | Chen | |
| 2004/0079775 | A1 | 4/2004 | Choi et al. | |
| 2004/0089301 | A1 | 5/2004 | Choi et al. | |
| 2004/0159820 | A1 | 8/2004 | Yang | |
| 2004/0164043 | A1 | 8/2004 | Hakim | |
| 2004/0217139 | A1 | 11/2004 | Roth | |
| 2004/0217187 | A1 | 11/2004 | Renz et al. | |
| 2004/0222230 | A1 | 11/2004 | Samson et al. | |
| 2005/0029271 | A1 | 2/2005 | McDonough | |
| 2005/0029313 | A1 | 2/2005 | Robins et al. | |
| 2005/0045647 | A1 | 3/2005 | Hession et al. | |
| 2005/0056610 | A1 | 3/2005 | Randolph et al. | |
| 2005/0056652 | A1 | 3/2005 | Cezeaux | |
| 2005/0072788 | A1 | 4/2005 | Lieberman et al. | |
| 2005/0072804 | A1 | 4/2005 | Brown | |
| 2005/0115966 | A1 | 6/2005 | Leoncavallo et al. | |
| 2005/0133505 | A1 | 6/2005 | Yoneoka et al. | |
| 2005/0133519 | A1 | 6/2005 | McDonough | |
| 2005/0184075 | A1 | 8/2005 | Belcastro | |
| 2005/0205587 | A1 | 9/2005 | Samson et al. | |
| 2005/0218242 | A1 | 10/2005 | Renz et al. | |
| 2006/0186135 | A1 * | 8/2006 | Rose | B65D 1/32 222/78 |
| 2007/0114202 | A1 | 5/2007 | Lee | |
| 2008/0006718 | A1 | 1/2008 | Junkel et al. | |
| 2009/0071962 | A1 * | 3/2009 | Lindsay | B65D 47/244 220/288 |
| 2010/0012532 | A1 | 1/2010 | Frutin | |
| 2010/0288758 | A1 * | 11/2010 | Blain | B65D 47/243 220/23.83 |
| 2011/0174993 | A1 | 7/2011 | Blain | |
| 2015/0343470 | A1 | 12/2015 | Chang | |
| 2016/0150898 | A1 | 6/2016 | Hoskins | |
| 2016/0200486 | A1 | 7/2016 | Meyers et al. | |
| 2017/0009979 | A1 | 1/2017 | Willows et al. | |
| 2017/0166364 | A1 | 6/2017 | Jones | |
| 2017/0190481 | A1 | 7/2017 | Leimone et al. | |
| 2018/0050844 | A1 | 2/2018 | Hirst et al. | |
| 2018/0086517 | A1 | 3/2018 | Heiberger et al. | |
| 2018/0192800 | A1 | 7/2018 | Coon et al. | |

FOREIGN PATENT DOCUMENTS

| | | | |
|---|---|---|---|
| CN | 1394186 | A | 1/2003 |
| CN | 201185736 | Y | 1/2009 |
| CN | 101184674 | B | 5/2010 |
| CN | 202874282 | U | 4/2013 |
| CN | 202967016 | U | 6/2013 |
| CN | 203505876 | U | 4/2014 |
| CN | 205018508 | U | 2/2016 |
| CN | 205696381 | U | 11/2016 |
| CN | 107028335 | A | 8/2017 |
| DE | 9303734 | U1 | 7/1993 |
| DE | 202016000593 | U1 | 6/2016 |
| DE | 202016005277 | U1 | 12/2016 |
| EP | 0266067 | A1 | 5/1988 |
| EP | 0276198 | A2 | 7/1988 |
| EP | 0291326 | A1 | 11/1988 |
| EP | 1095599 | | 5/2001 |
| FR | 1397859 | A | 4/1965 |
| FR | 2663300 | A1 | 12/1991 |
| GB | 882399 | | 11/1961 |
| GB | 2279130 | A | 12/1994 |
| GB | 2284202 | B | 4/1997 |
| GB | 2448549 | A | 10/2008 |
| JP | 09122541 | A | 5/1997 |
| JP | 2002-326655 | A | 11/2002 |
| JP | 2013047116 | A | 3/2013 |
| TW | M447366 | U1 | 2/2013 |
| TW | M473371 | U | 3/2014 |
| TW | M522203 | U | 5/2016 |
| TW | M527858 | U | 9/2016 |
| WO | WO 97/05055 | | 2/1997 |
| WO | WO 98/46106 | | 10/1998 |
| WO | WO 00/03946 | | 1/2000 |
| WO | WO 00/12179 | A1 | 3/2000 |
| WO | WO 00/49922 | | 8/2000 |
| WO | WO 03/031315 | | 4/2003 |
| WO | WO 2007/109863 | A1 | 10/2007 |
| WO | WO 2008/084256 | A1 | 7/2008 |
| WO | WO 2013/171351 | A1 | 11/2013 |
| WO | WO 2014/190499 | A1 | 12/2014 |
| WO | WO 2015/051231 | A1 | 4/2015 |
| WO | WO 2015/169995 | A1 | 11/2015 |
| WO | WO 2015/179569 | A1 | 11/2015 |
| WO | WO 2017/078692 | A1 | 5/2017 |

OTHER PUBLICATIONS

English-language abstract of Chinese Patent No. CN 85106703 A, European Patent Office, May 10, 1986.

English-language machine translation of French Patent Publication No. FR 2663300 A1, Global Patent Solutions, Oct. 4, 2017.

(56) References Cited

OTHER PUBLICATIONS

English-language machine translation of German Utility Model No. DE 9303734 U1, Global Patent Solutions, Oct. 4, 2017.
English-language machine translation of Japanese Patent Publication No. JP 09122541 A, Global Patent Solutions, May 22, 2017.
English-language abstract of Chinese Patent No. CN 1198083 A, European Patent Office, Nov. 4, 1998.
English-language abstract of Japanese Patent No. 2002-326655 A, European Patent Office, Nov. 12, 2002.
English-language abstract of Chinese Patent No. CN 1394186 A, European Patent Office, Jan. 29, 2003.
English-language machine translation of Chinese Utility Model No. CN 201185736 Y, Global Patent Solutions, Oct. 4, 2017.
English-language machine translation of Chinese Patent Application Publication No. CN 101184674 B, Global Patent Solutions, Oct. 4, 2017.
English-language machine translation of Taiwanese Utility Model No. TW M447366 U1, Global Patent Solutions, Oct. 4, 2017.
English-language machine translation of Japanese Patent Publication No. JP 2013047116 A, Global Patent Solutions, May 22, 2017.
English-language machine translation of Chinese Utility Model Publication No. CN 202874282 U, Global Patent Solutions, Oct. 4, 2017.
English-language machine translation of Chinese Utility Model No. 202967016 U, Global Patent Solutions, May 22, 2017.
English-language abstract of PCT Patent Application Publication No. WO 2013/171351 A1, European Patent Office, Nov. 21, 2013.
English-language machine translation of Taiwanese Utility Model No. TW M473371 U, Global Patent Solutions, Oct. 4, 2017.
English-language machine translation of Chinese Utility Model Publication No. CN 203505876 U, Global Patent Solutions, Oct. 4, 2017.
English-language machine translation of PCT Patent Application Publication No. WO 2015/169995 A1, Global Patent Solutions, Oct. 4, 2017.
English-language machine translation of Chinese Utility Model Publication No. CN 205018508 U, Global Patent Solutions, Oct. 4, 2017.
English-language machine translation of Taiwanese Utility Model No. TW M522203 U, Global Patent Solutions, Oct. 4, 2017.
English-language machine translation of German Utility Model No. DE 202016000593 U1, Global Patent Solutions, Oct. 4, 2017.
English-language machine translation of Taiwanese Utility Model No. TW M527858 U, Global Patent Solutions, Oct. 4, 2017.
English-language machine translation of Chinese Utility Model Publication No. CN 205696381 U, Global Patent Solutions, Oct. 4, 2017.
English-language machine translation of German Utility Model No. DE 202016005277 U1, Global Patent Solutions, Oct. 4, 2017.
English-language machine translation of Chinese Patent Application Publication No. CN 107028335 A, Global Patent Solutions, Oct. 4, 2017.
European Community Design Registration No. 000979802-0001, Jul. 25, 2008.
European Community Design Registration No. 000979802-0002, Jul. 25, 2008.
European Community Design Registration No. 000979802-0003, Jul. 25, 2008.
4 oz Powder Bottle, https://www.elementsbathandbody.com/4-oz-Powder-Bottle.html, retrieved May 22, 2017, 2 pages.
Bottle Blasters Water Bottle Cap—Mobile Shower, Pet Shower Sprayer, Pet Bath Tool, Portable Camping Shower Outdoor, Hiking Bladder Accessory, https://www.amazon.com/Bottle-Blasters-Water-Cap-Accessory/dp/B01J9K8VKM/, retrieved May 22, 2017, 8 pages.
Selecting a Running Water Bottle: How the Cap Makes a Difference, http://blog.runningwarehouse.com/gear/running-accessories/hydration-tips-5-types-of-water-bottle-caps/, retrieved May 22, 2017, 4 pages.

* cited by examiner

CLOSURE ASSEMBLIES AND DRINK CONTAINERS INCLUDING THE SAME

FIELD

The present disclosure relates to closure assemblies and drink containers including the same.

BACKGROUND

Many individuals carry drink containers that hold water or other hot or cold potable beverages. These drink containers typically include a vessel that is formed from plastic or metal. These containers also frequently include a closure, which is removably secured to a neck or other opening of the vessel. Some conventional drink containers further include a drink spout, or nozzle, that is integral with the closure and from which liquid may be drawn from the vessel without removal of the closure from the vessel. Some such nozzles include a manual or automatic valve for selectively restricting liquid from being dispensed through the drink spout, and some do not. For example, some such drink containers have a closure with a drink spout that may be selectively opened and closed to permit a user to selectively seal and unseal the drink spout, and some drink containers and/or closures further include a manual actuator for selectively opening and closing the drink spout. Examples of such drink containers with valved drink spouts include squeezable drink containers with rotating or push-pull drink spouts and CAMELBAK® brand drink containers with bite-actuated mouthpieces. When such containers are used with beverages other than water, such as that include sugar or other suspended particulates that may stick to or otherwise foul components associated with drink spouts, valves, or other components of the closure, it may be difficult to clean these portions of the closure. Thus, there exists a need for drink containers with improved closure assemblies.

SUMMARY

Closure assemblies and drink containers including the same are disclosed herein. A drink container includes a liquid vessel having a neck with an opening and having an internal compartment configured to hold a volume of potable drink liquid.

A closure assembly for the drink container includes a closure base configured to be selectively coupled to the neck of the liquid vessel to selectively couple the closure assembly to the liquid vessel. The closure base defines a base interior side that faces toward the internal compartment when the closure assembly is operatively coupled to the liquid vessel, a base exterior side that faces away from the internal compartment when the closure assembly is operatively coupled to the liquid vessel, and a closure base passage that extends between and fluidly connects the base interior side and the base exterior side.

The closure assembly additionally includes a valve insert operatively received within the closure base passage. The valve insert includes a liquid inlet configured to receive the potable drink liquid from the liquid compartment of the liquid vessel and a liquid outlet configured to dispense the potable drink liquid from the closure assembly. The valve insert extends through the closure base passage when the valve insert is operatively received within the closure base passage. The valve insert is configured to be selectively and repeatedly received within and removed from the closure base passage. The valve insert is configured to be selectively rotated relative to the closure base about a rotational axis to transition the closure assembly between a closed configuration and a drink configuration when the valve insert is operatively received within the closure base passage. In the drink configuration, the valve insert permits flow of the potable drink liquid from the internal compartment through the liquid inlet and to the liquid outlet. In the closed configuration, the valve insert restricts flow of the potable drink liquid from the internal compartment through the liquid inlet and to the liquid outlet.

The closure assembly further includes a valve insert retainer configured to be selectively and repeatedly coupled to and removed from the valve insert and configured to prevent removal of the valve insert from the closure base when the valve insert retainer is operatively coupled to the valve insert. The valve insert retainer is operatively coupled to the valve insert on the base interior side of the closure base when the valve insert is operatively received within the closure base passage and when the valve insert retainer is operatively coupled to the valve insert. The valve insert retainer prevents removal of the valve insert from the closure base when the valve insert is operatively received within the closure base passage and when the valve insert retainer is operatively coupled to the valve insert. The valve insert is configured to be selectively and repeatedly received by and removed from the closure base passage only via the base exterior side and only when the valve insert retainer is selectively removed from the valve insert.

DETAILED DESCRIPTION

FIGS. 1-17 provide examples of drink containers 10, of liquid vessels 20, and/or of closure assemblies 100, according to the present disclosure. Elements that serve a similar, or at least substantially similar, purpose are labeled with like numbers in each of FIGS. 1-17, and these elements may not be discussed in detail herein with reference to each of FIGS. 1-17. Similarly, all elements may not be labeled in each of FIGS. 1-17, but reference numbers associated therewith may be utilized herein for consistency. Elements, components, and/or features that are discussed herein with reference to one or more of FIGS. 1-17 may be included in and/or utilized with the subject matter of any of FIGS. 1-17 without departing from the scope of the present disclosure.

In general, elements that are likely to be included in a given (i.e., a particular) embodiment are illustrated in solid lines, while elements that are optional to a given embodiment are illustrated in dash-dot lines. However, elements that are shown in solid lines are not essential to all embodiments, and an element shown in solid lines may be omitted from a given embodiment without departing from the scope of the present disclosure.

Figure 1:
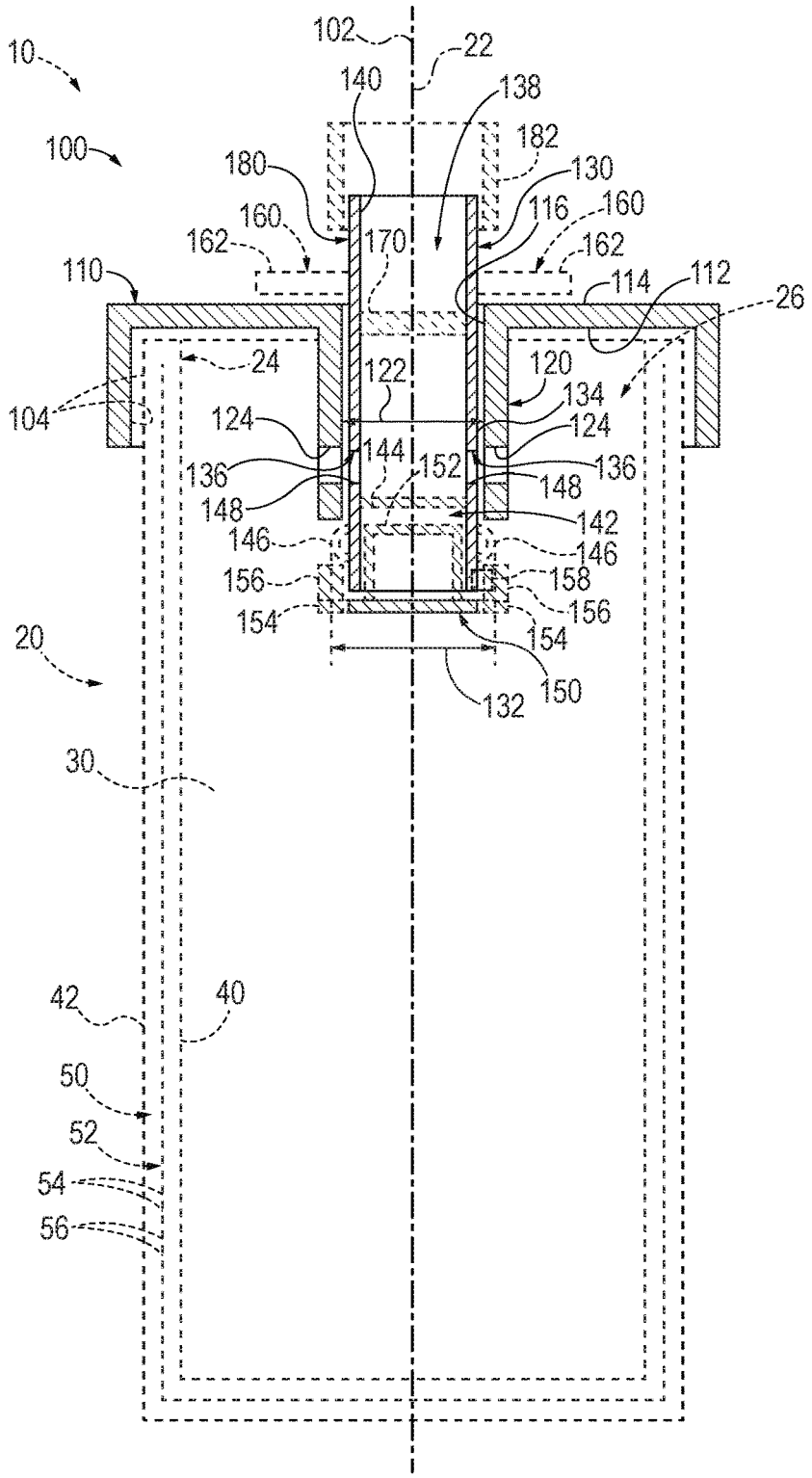
FIG. 1 is a schematic cross-sectional side elevation view representing examples of drink containers including cap assemblies according to the present disclosure.
Figure 2:
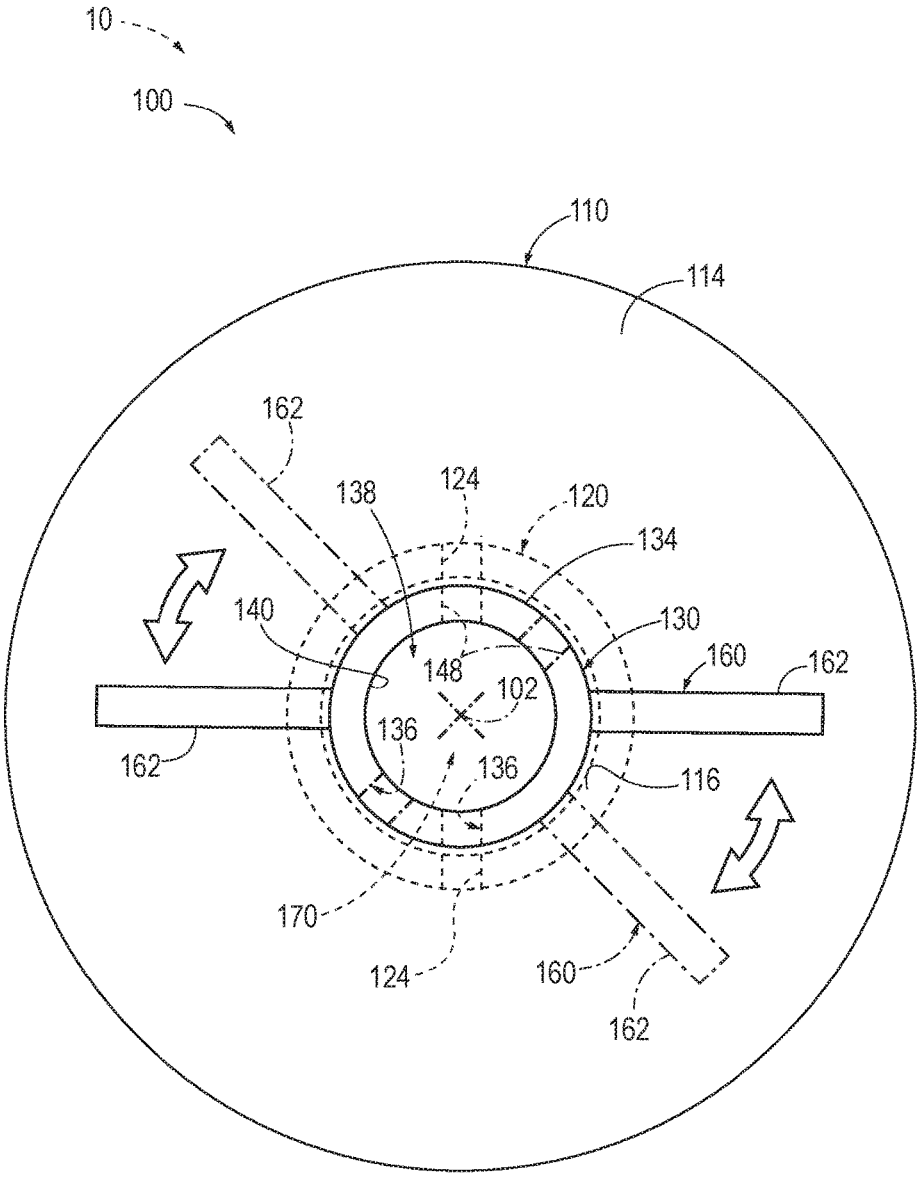
FIG. 2 is a schematic top plan view representing examples of cap assemblies according to the present disclosure.

FIG. 1 is a schematic cross-sectional side elevation view of examples of a drink container 10 that includes a liquid vessel 20 and a closure assembly 100. FIG. 2 is a schematic top plan view of examples of closure assembly 100. As schematically illustrated in FIG. 1, liquid vessel 20 includes a neck 24 with an opening 26. Liquid vessel 20 further includes an internal compartment 30 configured to hold a volume of a potable drink liquid. Examples of potable drink liquids that may be used in drink containers 10 according to the present disclosure include such potable liquids as water, juice, sports drinks, and the like. Closure assembly 100 is configured to be selectively coupled to neck 24 of liquid container 20. More specifically, closure assembly 100 includes a closure base 110 configured to be selectively coupled to neck 24 of liquid vessel 20 to selectively couple the closure assembly to the liquid vessel. When closure assembly 100 is coupled to the neck 24 of liquid vessel 20, the closure assembly may be described as covering, obstructing, and/or selectively preventing drink liquid from being dispensed from the liquid vessel through opening 26.

As schematically illustrated in FIGS. 1-2, closure base 110 defines a base interior side 112, which faces toward internal compartment 30 when closure assembly 100 is operatively coupled to liquid vessel 20, and a base exterior side 114, which faces away from the internal compartment when the closure assembly is operatively coupled to the liquid vessel. Closure base 110 additionally defines a closure base passage 116 that extends between and fluidly connects base interior side 112 and base exterior side 114.

As used herein, the term "side," as used with reference to a portion and/or component of drink container 10, may refer to the portion and/or component of the drink container, and/or may refer to a spatial region that is at least partially defined by the portion and/or component of the drink container. For example, base interior side 112 may refer to an interior portion and/or interior surface of closure base 110, and/or may refer to a portion and/or region of closure assembly 100 (and/or of a region adjacent to the closure assembly) that extends away from the interior surface of the closure base. Similarly, base exterior side 114 may refer to an exterior portion and/or exterior surface of closure base 110, and/or may refer to a portion and/or region of closure assembly 100 (and/or of a region adjacent to the closure assembly) that extends away from the exterior surface of the closure base.

As schematically illustrated in FIGS. 1-2, closure assembly 100 additionally includes a valve insert 130 operatively received within closure base passage 116. Valve insert 130 includes a liquid inlet 136, which is configured to receive the potable drink liquid, and a liquid outlet 140, which is configured to dispense the potable drink liquid. As schematically illustrated in FIG. 1, valve insert 130 additionally may include a drink spout 180 that extends away from closure base 110 when the valve insert is operatively received within closure base passage 116, and the drink spout may at least partially define liquid outlet 140. Stated differently, drink spout 180 may refer to a portion of valve insert 130 that extends away from closure base 110 on base exterior side 114. In such an embodiment, liquid outlet 140 may refer to a portion and/or region of drink spout 180 from which the potable drink liquid is dispensed. As additionally schematically illustrated in FIGS. 1-2, liquid inlet 136 may include at least one insert port 148 that extends through a sidewall 134 of valve insert 130. Each insert port 148 may have any appropriate form. As examples, each insert port 148 may include and/or be a cutout, a notch, a hole, and/or an aperture defined in sidewall 134. Valve insert 130 may include and/or define a valve passage 138 that fluidly couples liquid inlet 136 and liquid outlet 140, such that the potable drink liquid flows through the valve passage when the potable drink liquid is dispensed via closure assembly 100.

As schematically illustrated in FIG. 1, closure assembly 100 additionally or alternatively may include a self-sealing valve 170 positioned within valve passage 138. In such an embodiment, self-sealing valve 170 may be configured to permit flow of the potable drink liquid through valve passage 138 and to liquid outlet 140 only when a pressure of the potable drink liquid upon the self-sealing valve exceeds a predetermined threshold pressure. For example, this threshold pressure may be a selected pressure differential between the interior and exterior sides of the valve, which may be predetermined and/or preselected by the design and materials of construction of the valve. The threshold may be exceeded, for example, by a user squeezing the liquid vessel to increase the pressure being imparted to the interior side of the valve and/or by a user sucking upon the liquid outlet 140 and/or a mouthpiece (when present) to decrease the pressure imparted on the exterior side of the valve. As a more specific example, self-sealing valve 170 may include and/or be a slit diaphragm valve. An example of a suitable self-sealing valve 170 is disclosed in U.S. Pat. No. 5,439,143, the disclosure of which is incorporated by reference.

Valve insert 130 extends through closure base passage 116 when the valve insert is operatively received within the closure base passage. Valve insert 130 is configured to be selectively and repeatedly received within and removed from the closure base passage. For example, valve insert 130 may be selectively removed from closure base passage 116, and hence from closure base 110, to permit and/or facilitate cleaning of the valve insert apart from closure base 110. As further schematically illustrated in FIG. 1, and as discussed in more detail herein, closure assembly 100 additionally includes a valve insert retainer 150 configured to be selectively and repeatedly coupled to and removed from valve insert 130. More specifically, valve insert retainer 150 is configured to prevent removal of valve insert 130 from closure base 110 when the valve insert is operatively received within closure base passage 116 and when the valve insert retainer is operatively coupled to the valve insert. Stated differently, valve insert 150 may be configured to prevent inadvertent removal of valve insert 130 from closure base 110 during use of drink container 10.

Closure assembly 100 is configured to be selectively transitioned between a closed configuration, in which the closure assembly prevents the potable drink liquid from being dispensed through valve insert 130, and a drink configuration, in which the potable drink liquid may be dispensed through the valve insert. More specifically, when closure assembly 100 is in the closed configuration, valve insert 130 restricts flow of the potable drink liquid from internal compartment 30 through liquid inlet 136 and to liquid outlet 140. When closure assembly 100 is in the drink configuration, valve insert 130 permits flow of the potable drink liquid from internal compartment 30 through liquid inlet 136 and to liquid outlet 140. Stated differently, when valve insert 130 is operatively received within closure base passage 116 and when closure assembly 100 is in the drink configuration, the closure assembly may permit the potable drink liquid sequentially to enter the valve insert via liquid inlet 136 (such as via at least one insert port 148), flow through valve passage 138, and exit the valve insert via liquid outlet 140.

Valve insert 130 is configured to be selectively rotated relative to closure base 110 about a rotational axis 102 to transition closure assembly 100 between the closed configuration and the drink configuration when the valve insert is operatively received within closure base passage 116. As a more specific example, valve insert 130 may be configured to be selectively rotated about rotational axis 102 without concurrently translating along the rotational axis when the valve insert is operatively received within closure base passage 116. As schematically illustrated in FIG. 1, rotational axis 102 may be at least substantially parallel to and/or collinear with a longitudinal axis 22 of liquid vessel 20 when closure base 110 is operatively coupled to neck 24 of the liquid vessel. Additionally or alternatively, closure assembly 100 may be at least substantially rotationally symmetric about rotational axis 102. As schematically illustrated in FIGS. 1-2, and as discussed in more detail herein, closure assembly 100 may include an actuator 160 configured to be engaged by a user to selectively transition the closure assembly between the closed configuration and the drink configuration.

Liquid vessels 20 according to the present disclosure are adapted to receive and hold or otherwise contain up to a predetermined volume of potable drink liquid for selective consumption by a user, such as when the liquid is dispensed through liquid outlet 140 of closure assembly 100. Potable drink liquid may be selectively poured, or otherwise dispensed, into internal compartment 30 of the liquid vessel via neck 24. Potable drink liquid may be selectively dispensed from internal compartment 30 to a user from neck 24 when closure assembly 100 is not secured to the neck and/or when the closure assembly is in the drink configuration. It is within the scope of the present disclosure that neck 24 may (but is not required in all embodiments to) define the only opening through which potable drink liquid may be added to or removed from liquid vessel 20. As discussed in more detail herein, when closure assembly 100 is operatively coupled to liquid vessel 20, this selective dispensing of the drink liquid may be only through liquid outlet 140 of the closure assembly when the closure assembly is in the drink configuration.

Liquid vessels 20 may have any suitable shape and may be formed from any suitable material or combination of materials to hold up to a predetermined volume of drink liquid. Examples of suitable sizes, or capacities, of liquid vessels 20 (i.e., volume of potable drink liquid able to be received into a liquid vessel at one time) include 4 ounces (oz.), 6 oz., 8 oz., 10 oz., 12 oz., 16 oz., 20 oz., 24 oz., 32 oz., 36 oz., 4-11 oz., 6-15 oz., 10-19 oz., 12-25 oz., 12-36 oz., 15-30 oz., 25-36 oz., 30-45 oz., 35-50 oz., and 10-70 oz. (with these examples referring to liquid (fluid) ounces of drink liquid that may be received at one time into an empty liquid container). It is within the scope of the present disclosure that liquid vessels having different sizes, including sizes that are smaller than, larger than, or within the illustrative sizes and/or ranges presented above, may be used without departing from the scope of the present disclosure.

An example of a material that may be used to construct liquid vessels 20 according to the present disclosure includes the TRITAN™ copolyester polymer developed by Eastman Chemical Company. Other examples of materials that may be suitable for construction of liquid vessels, or portions thereof, according to the present disclosure include polycarbonate, glass, plastic, and/or metal, such as aluminum or stainless steel. Further examples are disclosed in U.S. Pat. Nos. 7,533,783 and 8,905,252, the complete disclosures of which are hereby incorporated by reference.

Liquid vessels 20 may be (but are not required to be) rigid or at least semi-rigid and may include a bottom surface such that the liquid vessel may be generally self-supporting, or free-standing, when placed on a horizontal surface. In such embodiments, drink containers 10 may be referred to as drink bottles. As discussed herein, liquid vessels 20 also optionally may have a double-wall or other insulated construction. In some embodiments, a liquid vessel 20 according to the present disclosure may be constructed of polyethylene or other material that permits the liquid vessel to have a semi-rigid construction in which the liquid vessel may be reversibly (and nondestructively) collapsed during use. Such an example may permit opposing portions of the liquid vessel to be squeezed and/or otherwise urged from a nominal, or un-collapsed configuration, toward, or even into contact with, each other to reduce the volume of the liquid vessel and thereby aid in the dispensing of potable drink liquid therefrom. In such an embodiment, the liquid vessel may be configured to return automatically to its prior (nominal) configuration upon reduction of the force and/or pressure that was applied to urge the sides of the liquid vessel toward each other. Such embodiments may be described as squeeze bottles, as having a squeezable liquid vessel, and/or as having a resiliently deformable liquid vessel. In other embodiments, a liquid vessel 20 according to the present disclosure may have a non-rigid and/or fully collapsible structure. In such an embodiment, the liquid vessel may not be configured to return automatically to its prior configuration upon reduction of the force and/or pressure that was applied to urge the sides of the liquid vessel toward each other, such as to dispense liquid from the liquid container through the closure assembly. For example, in such an embodiment, the liquid vessel may be configured to assume and maintain a configuration that is at least substantially flattened, collapsed, and/or deflated after the volume of the liquid vessel is reduced, such as by squeezing the liquid vessel and dispensing liquid from the liquid vessel through the closure assembly. Such embodiments may be described as flasks, soft flasks, flexible flasks, collapsible flasks, flexible water bottles, and/or collapsible water bottles.

Drink spout 180 may extend away from closure base 110 by any suitable height, such as heights that are, or are similar to, the thickness of the material forming the upper surface of closure base 110, as well as lengths that are 2, 3, 4, 5, 10, or more times this thickness. Additional examples of suitable lengths include lengths of at least 1 millimeter (mm), at least 2 mm, at least 3 mm, at least 4 mm, at least 5 mm, at least 10 mm, at least 15 mm, at least 20 mm, at least 25 mm, at least 30 mm, at least 40 mm, at least 1-10 mm, at least 5-30 mm, at least 10-50 mm, less than 50 mm, less than 40 mm, less than 30 mm, less than 20 mm, less than 15 mm, less than 10 mm, and/or less than 5 mm. Drink spout 180 may have any suitable size that is suitable for dispensing potable drink liquid from drink container 10 to a user's mouth. As examples, drink spout 180 and/or liquid outlet 140 thereof may have a cross-sectional area (measured transverse to the long axis of the drink spout) that is at least 50 square millimeters ($mm^2$), at least 75 $mm^2$, at least 100 $mm^2$, at least 200 $mm^2$, at least 300 $mm^2$, at least 400 $mm^2$, at least 500 $mm^2$, at least 600 $mm^2$, at least 50-300 $mm^2$, at least 100-500 $mm^2$, at least 250-750 $mm^2$, less than 750 $mm^2$, less than 600 $mm^2$, less than 500 $mm^2$, less than 400 $mm^2$, less than 300 $mm^2$, and/or less than 200 $mm^2$.

In some embodiments, drink spout 180 may define a structure that is configured to be received by a user's mouth. Drink spout 180 may be cylindrical, generally cylindrical, circular, elliptical, or may have any other suitable shape and/or cross-section, such as ergonomic shapes that facilitate comfortable engagement with a user's mouth for drinking potable drink liquid from drink container 10. Additionally or alternatively, and as schematically illustrated in FIG. 1, closure assembly 100 may include a mouthpiece 182 configured to be selectively and repeatedly attached to and removed from valve insert 130. For example, mouthpiece 182 may be configured to be selectively and repeatedly attached to and removed from drink spout 180, such as to provide a contact surface for engagement with a user's mouth that is washable and/or replaceable. Drink spout 180 and mouthpiece 182 each may be formed of any appropriate material. As examples, drink spout 180 and mouthpiece 182 each may be formed of a rigid material, a flexible material, a resiliently deformable material, a polymer, and/or silicone. As a more specific example, drink spout 180 may be formed of a rigid material, and mouthpiece 182 may be formed of a resiliently deformable material. As another example, drink spout 180 and mouthpiece 182 each may be formed of a resiliently deformable material. In some embodiments, mouthpiece 182 may not include a valve or other structure for selectively restricting flow of liquid though the liquid outlet from the valve passage. In other embodiments, mouthpiece 182 may be a self-sealing mouthpiece that includes a self-sealing valve that selectively prevents liquid from being dispensed through the mouthpiece unless that valve has been configured from its nominal closed configuration to a dispensing configuration, such as by a user biting upon opposed sidewalls of the mouthpiece to urge the sidewalls toward each other. Examples of suitable bite-actuated mouthpieces 182 are disclosed in U.S. Pat. No. 7,533,783, the disclosure of which is incorporated by reference.

Closure assemblies 100 according to the present disclosure may be adapted to be removably coupled to a liquid vessel 20 to cover, or otherwise enclose, the neck 24 thereof. When so coupled to liquid vessel 20, closure assembly 100 restricts drink liquid within internal compartment 30 of liquid vessel 20 from being dispensed from drink container 10 other than through liquid outlet 140. When liquid outlet 140 is obstructed or otherwise closed or sealed, such as when closure assembly 100 is in the closed configuration, the closure assembly restricts potable drink liquid from being dispensed from liquid vessel 20. Accordingly, any potable drink liquid in internal compartment 30 of liquid vessel 20 is restricted from being dispensed to a user or otherwise removed from the liquid container until either closure assembly 100 is uncoupled from the liquid vessel or until the closure assembly is transitioned to the drink configuration.

Closure assembly 100 is removably coupled to liquid vessel 20, such as to neck 24 thereof, to permit selective and non-destructive removal and replacement (i.e., repeated uncoupling and recoupling) of the closure assembly relative to the liquid vessel. For example, closure assembly 100 may be uncoupled from liquid vessel 20 to permit the liquid vessel to receive a volume of potable drink liquid, after which the closure assembly may be recoupled to the liquid container.

As schematically illustrated in FIG. 1, drink containers 10 according to the present disclosure may include a closure coupling mechanism 104 configured to selectively couple closure assembly 100 to liquid vessel 20. Closure coupling mechanism 104 may provide a liquid-tight connection between closure assembly 100 and liquid vessel 20. When such a connection is established between closure assembly 100 and liquid vessel 20, the closure assembly may restrict liquid from being dispensed from the drink container other than through liquid outlet 140. Neck 24 and/or closure base 110 may include at least a portion of closure coupling mechanism 104. As a more specific example, closure coupling mechanism 104 may include threads on neck 24 and threads on closure base 110 that matingly engage one another to selectively couple closure assembly 100 to liquid vessel 20. Additional examples of closure coupling mechanism 104 that may be incorporated into drink containers 10 according to the present disclosure include (but are not limited to) snap-fit arrangements, friction-fit arrangements, clasp arrangements, etc.

Valve insert 130 may be operatively coupled to and/or received within closure base 110 in any appropriate manner. For example, and as schematically illustrated in FIG. 1, valve insert 130 may extend away from base exterior side 114 of closure base 110 when the valve insert is operatively received within closure base passage 116. As additionally schematically illustrated in FIG. 1, valve insert retainer 150 may be operatively coupled to valve insert 130 on base interior side 112 of closure base 110 when the valve insert is operatively received within closure base passage 116 and when the valve insert retainer is operatively coupled to the valve insert. In this manner, valve insert retainer 150 may prevent removal of valve insert 130 from closure base 110 via base exterior side 114 when the valve insert is operatively received within closure base passage 116 and when the valve insert retainer is operatively coupled to the valve insert. Conversely, when valve insert retainer 150 is removed from valve insert 130, the valve insert may be selectively and repeatedly received by and removed from closure base passage 116 via base exterior side 114. Additionally or alternatively, valve insert 130 may be prevented from being received within or removed from closure base passage 116 via base interior side 112. For example, actuator 160 may prevent removal of valve insert 130 from closure base 110 via base interior side 112 when the valve insert is operatively received within closure base passage 116. Hence, in such a configuration, valve insert 130 may be configured to be selectively and repeatedly received by and removed from closure base 110 and/or closure base passage 116 only via base exterior side 114 and only when valve insert retainer 150 is selectively removed from the valve insert.

Closure assembly 100 may be configured to transition between the closed configuration and the drink configuration in any appropriate manner and/or by any appropriate mechanism. For example, and as discussed, closure assembly 100 may include actuator 160 for selectively transitioning the closure assembly between the closed configuration and the drink configuration. As a more specific example, and as schematically illustrated in FIGS. 1-2, actuator 160 may include at least one actuator arm 162 (such as one, two, or more actuator arms 162) extending radially away from valve insert 130 on base exterior side 114 of closure base 110. As examples, each actuator arm 162 may be integrally formed with valve insert 130 or may be rigidly coupled to the valve insert. In such an embodiment, each actuator arm 162 may be configured to selectively rotate valve insert 130 within closure base passage 116. For example, actuator 160 and/or actuator arm(s) 162 may be configured to rotate valve insert 130 with respect to closure base 110 about rotational axis 102. As a more specific example, actuator 160 and/or actuator arm(s) 162 may be configured to rotate valve insert 130 without concurrently translating the valve insert along the rotational axis.

Actuator 160 may be configured to rotate valve insert 130 with respect to closure base 110 to transition closure assembly 100 between the closed configuration and the drink configuration via a barrel valve mechanism. For example, and as schematically illustrated in FIGS. 1-2, closure base passage 116 may be at least partially defined by a base sleeve 120 that extends away from base interior side 112 of closure base 110 such that valve insert 130 extends at least partially through the base sleeve when the valve insert is operatively received within the closure base passage. Base sleeve 120 may be integrally formed with closure base 110 or may be coupled (such as rigidly coupled) to the closure base.

Base sleeve 120 may be configured to selectively permit and restrict fluid flow through liquid inlet 136 of valve insert 130. For example, and as schematically illustrated in FIGS. 1-2, base sleeve 120 may include at least one base port 124 that is selectively aligned with a corresponding insert port 148 when closure assembly 100 is in the drink configuration (schematically illustrated in solid and dashed lines in FIG. 2) to permit flow of the potable drink liquid from internal compartment 30 through liquid inlet 136 and to liquid outlet 140. Base sleeve 120 additionally may be configured such that each insert port 148 of liquid inlet 136 is blocked by the base sleeve when closure assembly 100 is in the closed configuration. Stated differently, each insert port 148 may be misaligned with each base port 124 when closure assembly 100 is in the closed configuration (schematically illustrated in dash-dot lines in FIG. 2). In such a configuration, base sleeve 120 may serve to prevent flow of the potable drink liquid from internal compartment 30 of liquid vessel 20 through liquid inlet 136 and to liquid outlet 140 when closure assembly 100 is in the closed configuration and when valve insert 130 is operatively received within closure base passage 116. Each base port 124 may have any appropriate form. As examples, each base port 124 may include and/or be a cutout, a notch, a hole, and/or an aperture defined in base sleeve 120.

As discussed, valve insert retainer 150 may be configured to be selectively coupled to valve insert 130 to prevent removal of the valve insert from closure base 110 when the valve insert is operatively received within closure base passage 116 and when the valve insert retainer is operatively coupled to the valve insert. Valve insert retainer 150 may be configured to be selectively coupled to valve insert 130 in any appropriate manner. For example, and as schematically illustrated in FIG. 1, valve insert 130 may define a retainer chamber 142 configured to receive at least a portion of valve insert retainer 150 when the valve insert retainer is operatively coupled to the valve insert. In such an embodiment, valve insert retainer 150 may include and/or be a retention plug 152 configured to be selectively inserted into retainer chamber 142 to couple the valve insert retainer to valve insert 130. For example, retention plug 152 may be received within retainer chamber 142 via a friction-fit engagement such that the retention plug remains coupled to valve insert 130 until the retention plug is selectively removed from the retainer chamber by a user. Valve insert retainer 150 and/or retention plug 152 may be formed of any appropriate material, such as a rigid material, a flexible material, a resiliently deformable material, a polymer, a plastic, a rubber, and/or silicone.

Retainer chamber 142 may be fluidly coupled to liquid outlet 140 via valve passage 138. In such an embodiment, valve insert retainer 150 and/or retention plug 152 may fluidly separate internal compartment 30 of liquid vessel 20 and valve passage 138 of valve insert 130 when closure assembly 100 is operatively coupled to the liquid vessel and when the closure assembly is in the closed configuration. Alternatively, and as schematically illustrated in FIG. 1, retainer chamber 142 may be fluidly separated from valve passage 138 by a valve insert bulkhead 144.

Valve insert retainer 150 and/or retention plug 152 may prevent removal of valve insert 130 from closure base 110 when the valve insert is operatively received within closure base passage 116 and when the valve insert retainer is operatively coupled to the valve insert in any appropriate manner. For example, and as schematically illustrated in FIG. 1, base sleeve 120 may have and/or be characterized by a sleeve diameter 122, and valve insert 130 may have and/or be characterized by a maximum effective insert diameter 132 when valve insert retainer 150 is operatively coupled to the valve insert, such that the maximum effective insert diameter 132 is greater than the sleeve diameter. Stated differently, when valve insert retainer 150 is operatively coupled to valve insert 130, the valve insert retainer may serve to augment, produce, and/or maintain a value of maximum effective insert diameter 132 that is greater than sleeve diameter 122 such that the valve insert is prevented from passing through base sleeve 120. As an example, and as schematically illustrated in FIG. 1, valve insert 130 may include at least one retention protrusion 146 extending away from rotational axis 102 when retention plug 152 is operatively received within retainer chamber 142. In such an example, maximum effective insert diameter 132 may be equal to the diameter of a smallest circle that circumscribes each retention protrusion 146 when retention plug 152 is operatively received within retainer chamber 142, which in turn may be greater than sleeve diameter 122. Thus, in such an embodiment, each retention protrusion 146 prevents removal of valve insert 130 from closure base 110 when the valve insert is operatively received with closure base passage 116 and when retention plug 152 is operatively received within retainer chamber 142. Stated differently, valve insert retainer 150 and/or retention plug 152 may prevent each retention protrusion 146 from flexing toward rotational axis 102 when the retention plug is operatively received within retainer chamber 142, thereby maintaining each retention protrusion in a position such that valve insert 130 is prevented from being removed from closure base 110. Alternatively, when retention plug 152 is removed from retainer chamber 142, each retention protrusion 146 may be configured to move toward rotational axis 102 to permit valve insert 130 to be removed from closure base 110 via base exterior side 114.

Each retention protrusion 146 may have any appropriate nominal position and/or configuration, such as when retention plug 152 is removed from retainer chamber 142. For example, each retention protrusion 146 may be biased away from rotational axis 102, such as to restrict (but not prevent) removal of valve insert 130 from closure base 110 when the valve insert is operatively received within closure base passage 116 and when retention plug 152 is removed from retainer chamber 142. In such an embodiment, each retention protrusion 146 may be configured to resiliently flex toward rotational axis 102 to permit valve insert 130 to be removed from closure base 110 via base exterior side 114. As more specific examples, each retention protrusion 146 may be configured to be flexed manually toward rotational axis 102, and/or may be configured to flex toward the rotational axis responsive to engagement with base sleeve 120 as the valve insert is withdrawn from the base sleeve via base exterior side 114. As another example, each retention protrusion 146 may be biased and/or otherwise configured to flex away from rotational axis 102 when retention plug 152 is operatively received within retainer chamber 142. Stated differently, each retention protrusion 146 may be configured to flex away from rotational axis 102 responsive to and/or concurrent with retention plug 152 being inserted into retainer chamber 142.

As further schematically illustrated in FIG. 1, valve insert retainer 150 may include a retainer flange 154 positioned adjacent to an end of valve insert 130 and that extends radially outwardly of the valve insert. For example, retainer flange 154 may prevent removal of valve insert 130 from closure base 110 when the valve insert is operatively received within closure base passage 116 and when valve insert retainer 150 is operatively coupled to the valve insert. As a more specific example, retainer flange 154 may extend radially outwardly of valve insert 130 by a sufficient distance that maximum effective insert diameter 132 is equal to the diameter of a smallest circle that circumscribes the retainer flange, which in turn may be larger than sleeve diameter 122. In an embodiment of closure assembly 100 that includes the plurality of retention protrusions 146 as well as retainer flange 154, maximum effective insert diameter 132 may be defined and/or determined by the plurality of retention protrusions and/or by the retainer flange. For example, in such an embodiment, maximum effective insert diameter 132 may refer to the diameter of the smallest circle that circumscribes the plurality of retention protrusions 146, or may refer to the diameter of the smallest circle that circumscribes retainer flange 154, regardless of which diameter is larger. When present, retainer flange 154 additionally or alternatively may facilitate removal of valve insert retainer 150 from valve insert 130. For example, in an embodiment of valve insert retainer 150 that includes retention plug 152, retainer flange 154 may provide a user with a surface to grip to pull the retention plug out of retainer chamber 142.

As further schematically illustrated in FIG. 1, valve insert retainer 150 may include a retainer skirt 156 configured to extend at least partially around valve insert 130 and/or base sleeve 120 to operatively couple the valve insert retainer to the valve insert. For example, retainer skirt 156 may extend at least partially and/or fully around a circumference of valve insert 130 when valve insert retainer 150 is operatively coupled to the valve insert. In such an embodiment, maximum effective insert diameter 132 additionally or alternatively may be equal to the diameter of a smallest circle that circumscribes retainer skirt 156. In such an embodiment, valve insert retainer 150 also may be referred to as a retainer cap. As schematically illustrated in FIG. 1, retainer skirt 156 may be configured to be operatively coupled to valve insert 130 via a retainer coupling mechanism 158. Retainer coupling mechanism 158 may include and/or be any appropriate mechanism, examples of which include a friction-fit coupling and a threaded coupling.

As discussed, liquid vessel 20 may have an insulated construction. For example, and as schematically illustrated in FIG. 1, liquid vessel 20 may include an inner wall 40 that at least partially defines internal compartment 30 and an outer wall 42 configured to be gripped by a user. In such an embodiment, liquid vessel 20 additionally may include an insulation layer 50 configured to restrict a transfer of heat energy through the liquid vessel, such as to maintain the potable drink liquid at a temperature that is lower or higher than an ambient temperature. When present, insulation layer 50 may be positioned between inner wall 40 and outer wall 42. Insulation layer 50 may be formed of any appropriate material, such as a foam and/or a metallic foil. As additional examples, insulation layer 50 may include and/or be a fluid, such as a liquid, a gas, air, and/or a fluid with a low thermal conductivity. Alternatively, in some embodiments, liquid vessel 20 may be an insulated vessel with inner wall 40 and outer wall 42 but without a distinct insulation layer 50 positioned between the inner wall and the outer wall. In such an embodiment, a space between inner wall 40 and outer wall 42 may be at least partially evacuated.

When present, insulation layer 50 may be formed and/or positioned within liquid vessel 20 in any appropriate manner. As examples, insulation layer 50 may be formed on inner wall 40 and/or on outer wall 42, or may be adhered to the inner wall and/or to the outer wall. Insulation layer 50 may be at least substantially opaque. Additionally or alternatively, insulation layer 50 may be at least partially optically transparent and/or optically translucent. As an example, and as schematically illustrated in FIG. 1, insulation layer 50 may include a liquid level indicator 52 configured to permit visual inspection of internal compartment 30 of liquid vessel 20 when closure assembly 100 is operatively coupled to the liquid vessel. More specifically, liquid level indicator 52 may be configured to permit visual inspection of the volume of the potable drink liquid within liquid vessel 20, such as to permit a user to determine how much liquid remains within the liquid vessel without removing closure assembly 100 from the liquid vessel.

Liquid level indicator 52 may include and/or be a region of an otherwise non-transparent and/or opaque insulation layer 50 that is at least partially optically transparent and/or optically translucent. Stated differently, insulation layer 50 may be at least substantially optically opaque in a portion of the insulation layer that does not include liquid level indicator 52. Additionally or alternatively, liquid level indicator 52 may include a plurality of distinct liquid level indicator features 54 defined in insulation layer 50. As examples, each liquid level indicator feature 54 may include and/or be an aperture defined by an otherwise opaque insulation layer 50. When present, the plurality of liquid level indicator features 54 may be distributed about a longitudinal extent of insulation layer 50 to permit visual inspection of a corresponding plurality of volumes of the potable drink liquid within liquid vessel 20. Stated differently, when the plurality of liquid level indicator features 54 is distributed about a longitudinal extent of insulation layer 50, the volume of potable drink liquid within liquid vessel 20 may be at least partially determined by observing (for example) an uppermost liquid level indicator feature 54 through which the potable drink liquid is visible when drink container 10 is maintained in an upright position. Additionally or alternatively, when present, the plurality of liquid level indicator features 54 may be distributed about an azimuthal (i.e., circumferential) extent of insulation layer 50. Such a configuration may facilitate inspection of the volume of the potable drink liquid within liquid vessel 20 from a plurality of distinct viewing angles. Additionally or alternatively, insulation layer 50 may include a plurality of liquid level indicator features 54 positioned on circumferentially opposed sides of the insulation layer. Such a configuration may permit light to pass through insulation layer 50 and/or internal compartment 30 of liquid vessel 20 via the liquid level indicator features on each of the circumferentially opposed sides, thereby facilitating viewing of the liquid level within the liquid vessel.

Each liquid level indicator feature 54 may have any appropriate form and/or shape. As examples, each liquid level indicator feature may have a shape that is a circle, an ellipse, a polygon, a triangle, a quadrilateral, a rectangle, and/or a square. In another embodiment, and as schematically illustrated in FIG. 1, liquid level indicator 52 and/or liquid level indicator feature 54 may include and/or be a liquid level indicator strip 56 extending along a longitudinal extent of the insulation layer. Additionally, liquid level indicator 52 and/or each liquid level indicator feature 54 may have any appropriate size. For example, liquid level indicator 52 and/or each liquid level indicator feature 54 may be sized so as to not substantially detract from a thermal insulation property of insulation layer 50. As a more specific example, insulation layer 50 may be at least substantially formed of a material with a thermal insulation that is quantified by a base R-value, and liquid level indicator 52 may be configured such that insulation layer 50 has an average R-value, as measured across a full surface area of the insulation layer. As examples, the average R-value of insulation layer 50 may be at least 70% of the base R-value, at least 80% of the base R-value, at least 90% of the base R-value, and/or at least 95% of the base R-value. The base R-value additionally or alternatively may be referred to as a predetermined R-value, a nominal R-value, and/or the R-value of the insulation layer 50 when the insulation layer does not include any liquid level indicator features 54.

Figure 3:
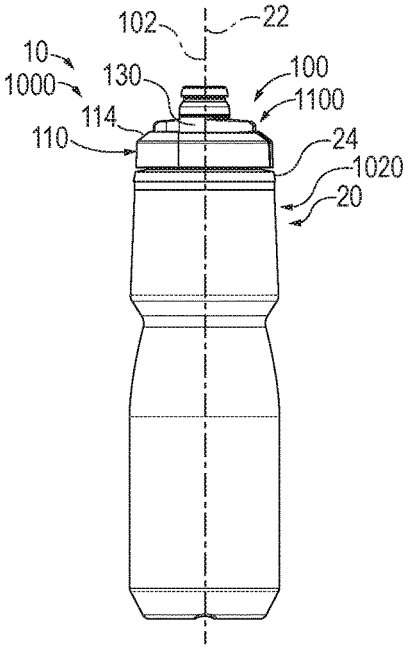
FIG. 3 is a side elevation view representing an example of a drink container with a closure assembly coupled to a liquid vessel according to the present disclosure.
Figure 4:
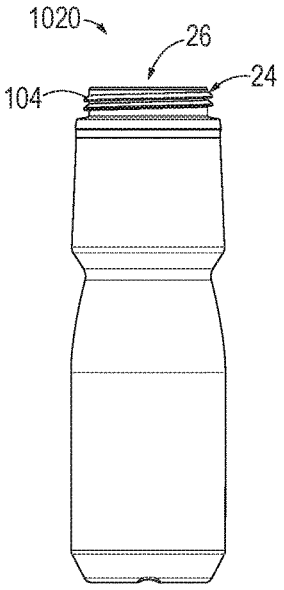
FIG. 4 is a side elevation view representing the liquid vessel of the drink container of FIG. 3.

Turning now to FIGS. 3-17, FIG. 3 illustrates a drink container 1000, which is an example of drink container 10. As illustrated in FIG. 3, drink container 1000 includes a closure assembly 1100, which is an example of closure assembly 100, coupled to neck 24 of a liquid vessel 1020, which is an example of liquid vessel 20. FIG. 4 illustrates liquid vessel 1020 in isolation. As illustrated in FIG. 4, drink container 1000 includes closure coupling mechanism 104 that includes threads defined on neck 24 of liquid vessel 1020 that mate with corresponding threads defined on closure base 110 of closure assembly 1100 (illustrated in FIGS. 8 and 10-15).

FIGS. 3-17 illustrate examples of drink containers 10, liquid vessels 20, and/or closure assemblies 100 with specific components, features, and/or options described above in the context of FIGS. 1-2. However, these examples are not limiting, and it is additionally within the scope of the present disclosure that the examples of FIGS. 3-17 additionally or alternatively may include any appropriate combination of components, features, properties, materials of construction, and/or options described herein, such as with respect to FIGS. 1-2.

FIGS. 5-14 illustrate closure assembly 1100 and/or components thereof in more detail. As illustrated in FIGS. 5-14, closure assembly 1100 includes valve insert 130 that extends fully through closure base passage 116 of closure base 110. Valve insert 130 of closure assembly 1100 is integrally formed with actuator 160, which includes a pair of actuator arms 162. Closure assembly 1100 additionally includes mouthpiece 182 operatively attached to drink spout 180 of valve insert 130.

Figure 5:
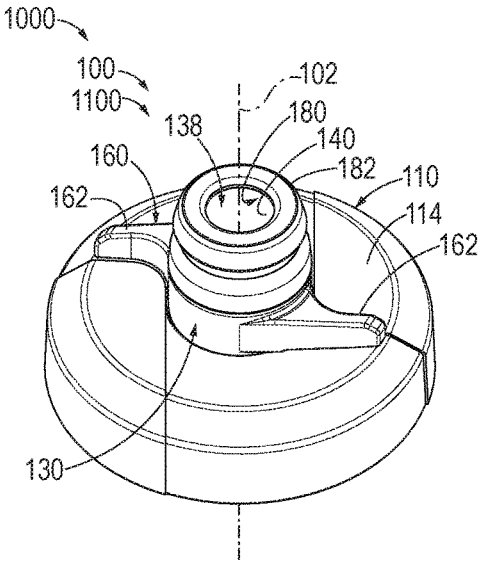
FIG. 5 is a top side isometric view representing the closure assembly of FIG. 3 in the drink configuration according to the present disclosure.
Figure 6:
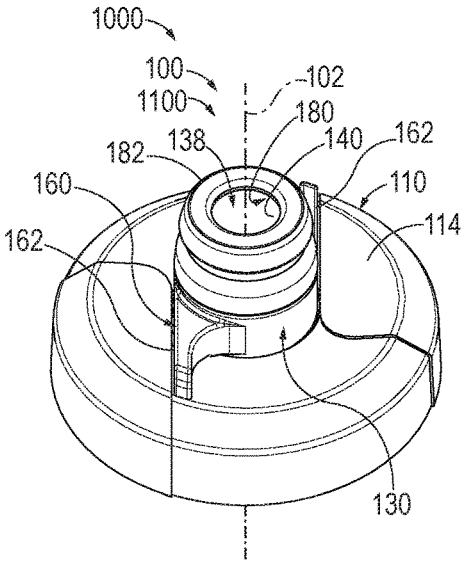
FIG. 6 is a top side isometric view representing the closure assembly of FIGS. 3 and 5 in the closed configuration.
Figure 7:
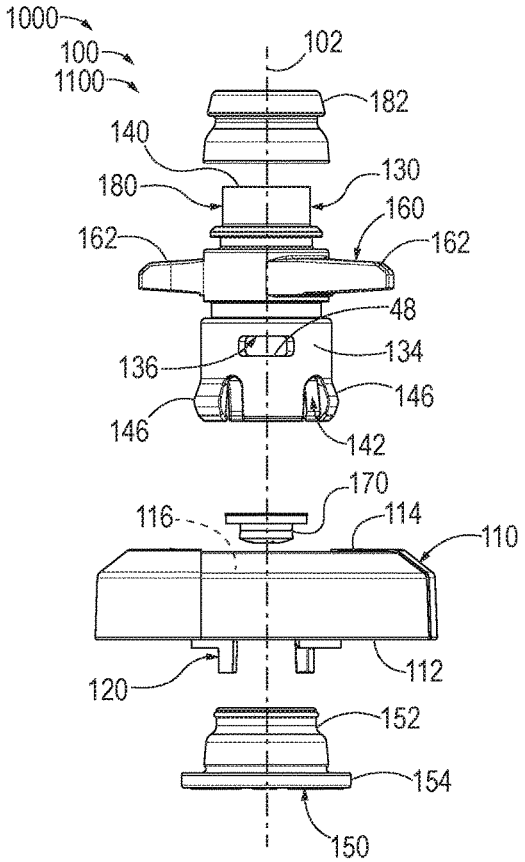
FIG. 7 is an exploded side elevation view representing the closure assembly of FIGS. 3 and 5-6.
Figure 8:
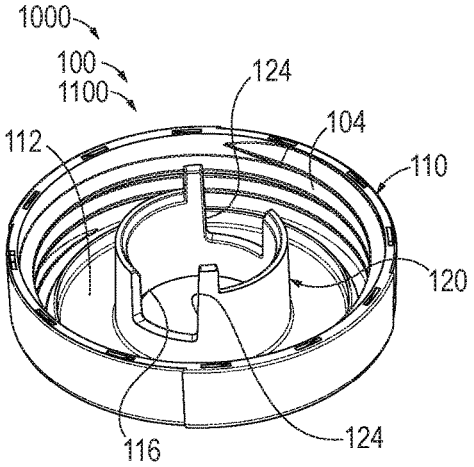
FIG. 8 is a bottom side isometric view representing the closure base of the closure assembly of FIGS. 3 and 5-7.
Figure 9:
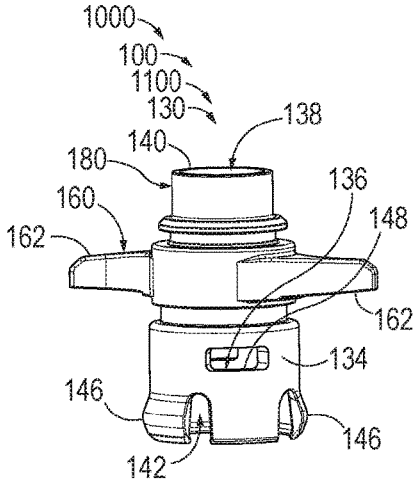
FIG. 9 is a side elevation view representing the valve insert of the closure assembly of FIGS. 3 and 5-7.
Figure 10:
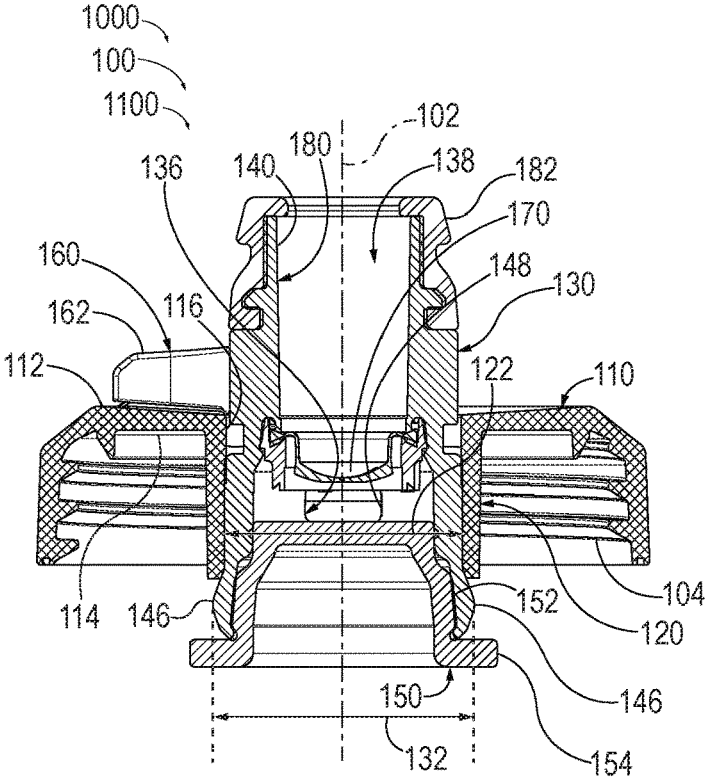
FIG. 10 is a cross-sectional side elevation view representing the closure assembly of FIGS. 3, 5-7, and 10 in the drink configuration and with the valve insert retainer coupled to the valve insert.
Figure 11:
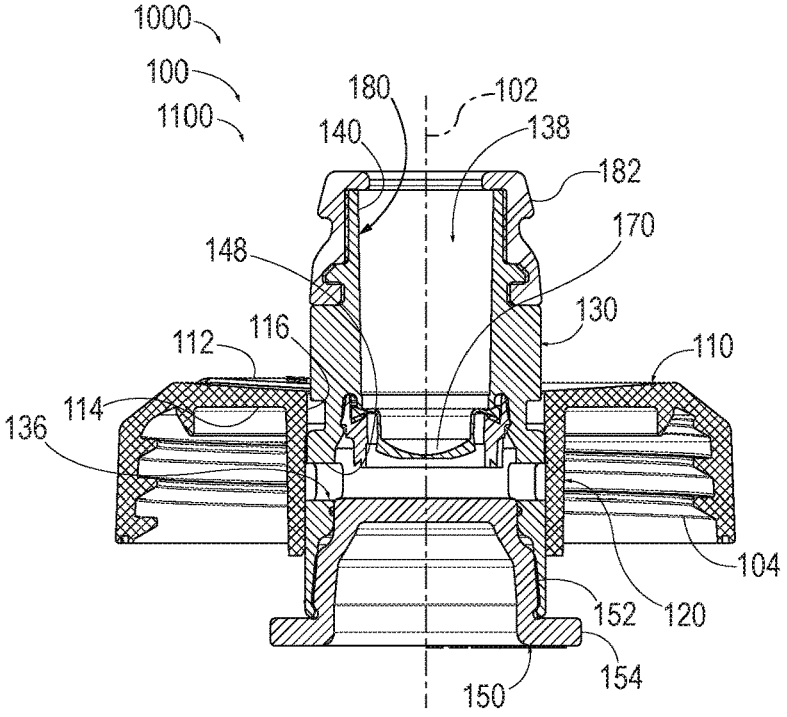
FIG. 11 is a cross-sectional side elevation view representing the closure assembly of FIGS. 3, 5-7, and 10 in the closed configuration and with the valve insert retainer coupled to the valve insert.
Figure 12:
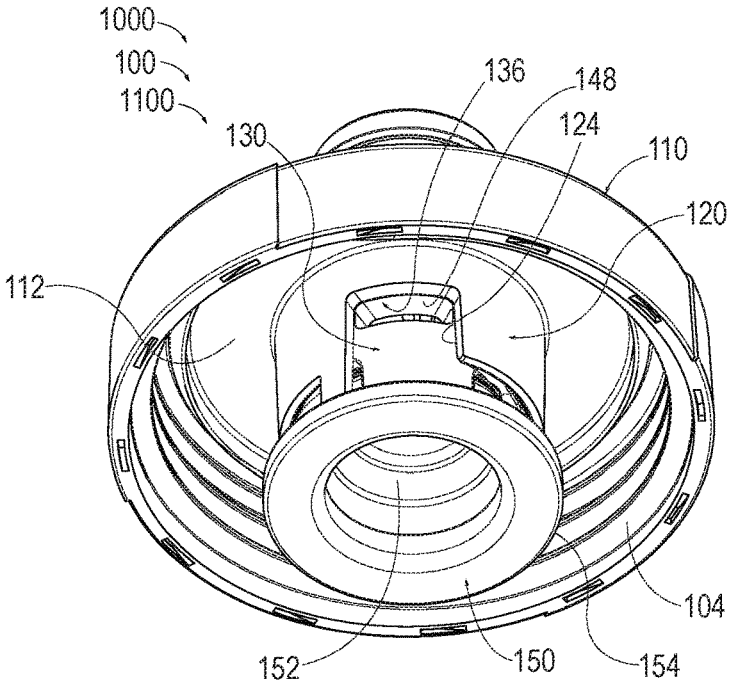
FIG. 12 is a bottom side isometric view representing the closure assembly of FIGS. 3, 5-7, and 10-11 in the drink configuration and with the valve insert retainer coupled to the valve insert.
Figure 13:
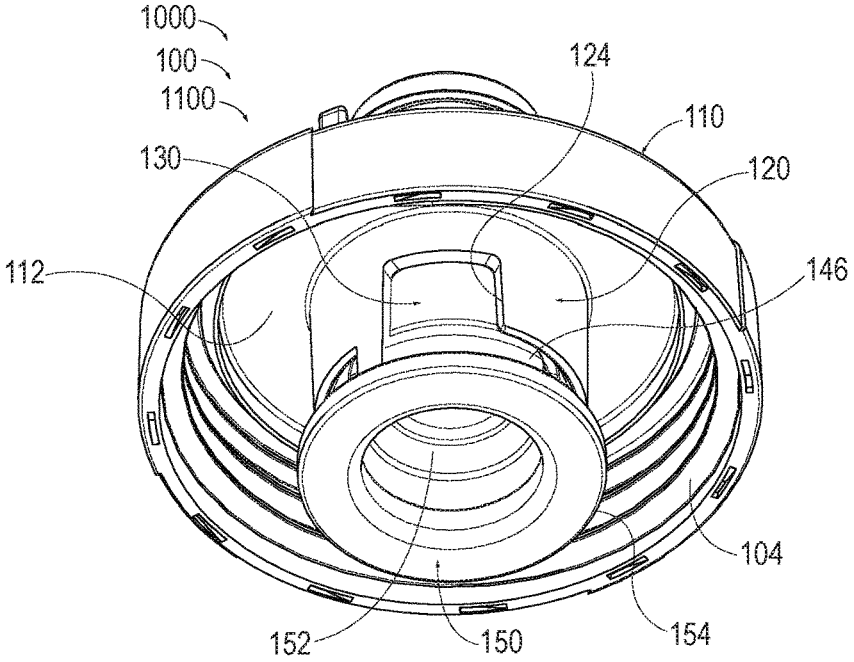
FIG. 13 is a bottom side isometric view representing the closure assembly of FIGS. 3, 5-7, and 10-12 in the closed configuration and with the valve insert retainer coupled to the valve insert.

FIGS. 5, 10, 12, and 14 illustrate closure assembly 1100 in the drink configuration, while FIGS. 6, 11, and 13 illustrate the closure assembly in the closed configuration. As illustrated in FIGS. 5-6, actuator arms 162 of actuator 160 rotate valve insert 130 about rotational axis 102 to transition closure assembly 1100 between the drink configuration and the closed configuration. As perhaps best illustrated in FIGS. 7 and 9, valve insert 130 of closure assembly 1100 includes a pair of opposed insert ports 148 defined in sidewall 134 of the valve insert. As perhaps best illustrated in FIG. 8, closure base 110 of closure assembly 1100 includes a pair of base ports 124 defined in base sleeve 120. As perhaps best illustrated in FIGS. 10 and 12, each insert port 148 is aligned with a corresponding base port 124 (illustrated in FIG. 12) when closure assembly 1100 is in the drink configuration to permit the potable drink liquid to flow into valve passage 138 (illustrated in FIG. 10) from base interior side 112. As perhaps best illustrated in FIG. 11, each insert port 148 is obstructed by base sleeve 120 when closure assembly 1100 is in the closed configuration to prevent the potable drink liquid from flowing into valve passage 138 from base interior side 112.

Figure 14:
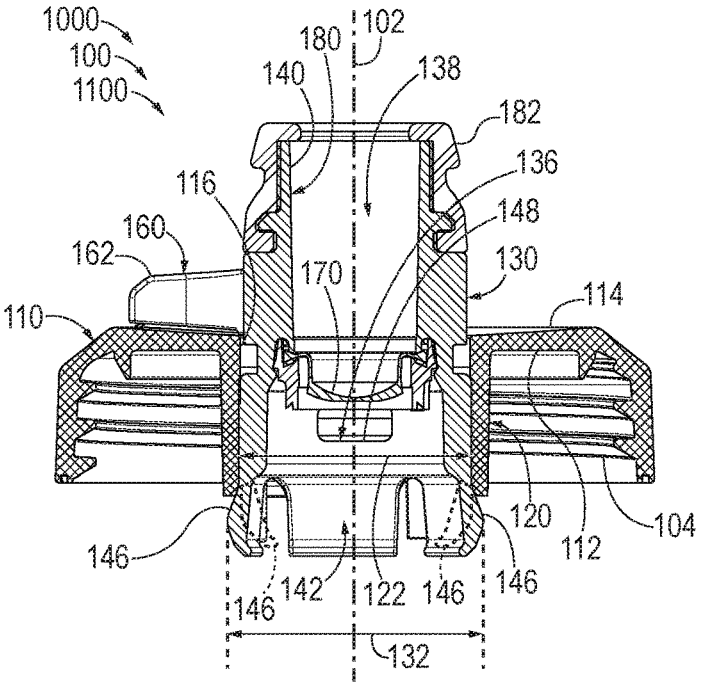
FIG. 14 is a cross-sectional side elevation view representing the closure assembly of FIGS. 3, 5-7, and 10-13 in the drink configuration and with the valve insert retainer removed from the valve insert.

As illustrated in FIGS. 7 and 10-14, closure assembly 1100 includes valve insert retainer 150 that includes retention plug 152 that is received within retainer chamber 142 of valve insert 130. More specifically, FIGS. 10-13 illustrate closure assembly 1100 with valve insert retainer 150 operatively coupled to valve insert 130, while FIG. 14 illustrates the closure assembly with the valve insert retainer removed from the valve insert. As perhaps best illustrated in FIGS. 10-11 and 14, valve insert 130 of closure assembly 1100 is configured such that retainer chamber 142 is fluidly coupled to liquid outlet 140 via valve passage 138.

Valve insert 130 of closure assembly 1100 includes a plurality of retention protrusions 146 that prevent removal of the valve insert from closure base 110 when the valve insert is operatively received within closure base passage 116 and when valve inset retainer 150 is operatively coupled to the valve insert. More specifically, and as illustrated in FIG. 10, the plurality of retention protrusions 146 are configured such that maximum effective insert diameter 132 is defined by the plurality of retention protrusions and is larger than sleeve diameter 122 of base sleeve 120 when retention plug 152 is received within retainer chamber 142. Additionally, closure assembly 1100 is configured such that retention plug 152 prevents each retention protrusion 146 from flexing toward rotational axis 102 when the retention plug is received within retainer chamber 142. Hence, retention plug 152 and the plurality of retention protrusions 146 of closure assembly 1100 collectively prevent valve insert 130 from being removed from closure base 110 when the valve insert is operatively received within closure base passage 116 and when valve insert retainer 150 is operatively coupled to the valve insert.

FIG. 14 illustrates closure assembly 1100 with insert retainer 150 removed from valve insert 130. As illustrated in FIG. 14, when insert retainer 150 is removed from valve insert 130, each retention protrusion 146 may be flexed toward rotational axis 102 (illustrated in dashed lines) to permit the valve insert to be selectively removed from closure base 110 via base exterior side 114.

Figure 15:
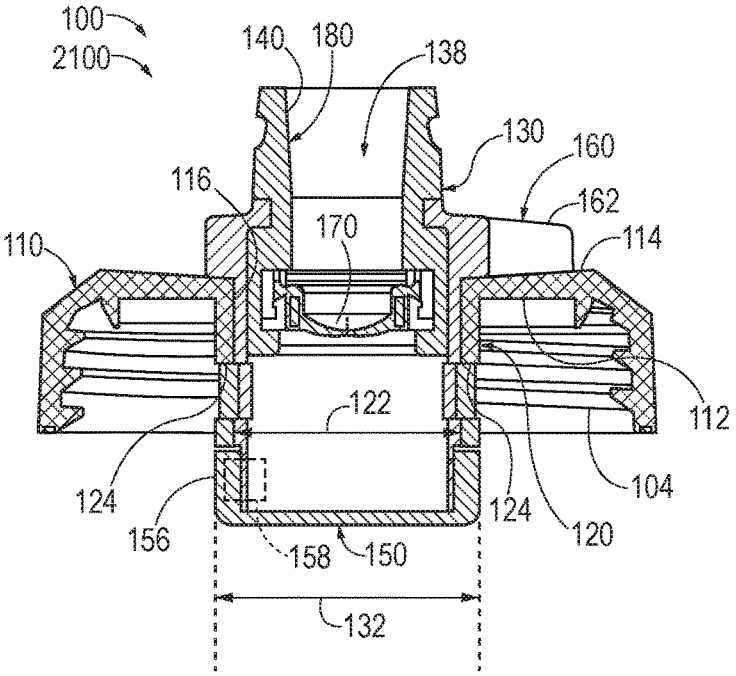
FIG. 15 is a cross-sectional side elevation view representing an example of a closure assembly with a valve insert retainer with a retainer skirt according to the present disclosure.

FIG. 15 illustrates a closure assembly 2100, which is another example of closure assembly 100. Closure assembly 2100 is substantially similar to closure assembly 1100 of FIGS. 5-14 with the exception that valve insert retainer 150 of closure assembly 2100 includes retainer skirt 156 that extends around a circumference of valve insert 130. Specifically, and as illustrated in FIG. 15, when valve insert retainer 150 of closure assembly 2100 is operatively coupled to valve insert 130, retainer skirt 156 produces a value of maximum effective insert diameter 132 that is greater than sleeve diameter 122, thereby preventing valve insert 130 from being removed from closure base 110 via base exterior side 114. As schematically illustrated in FIG. 15, valve insert retainer 150 of closure assembly 2100 additionally includes retainer coupling mechanism 158 to operatively couple the valve insert retainer and/or retainer skirt 156 to valve insert 130.

Figure 16:
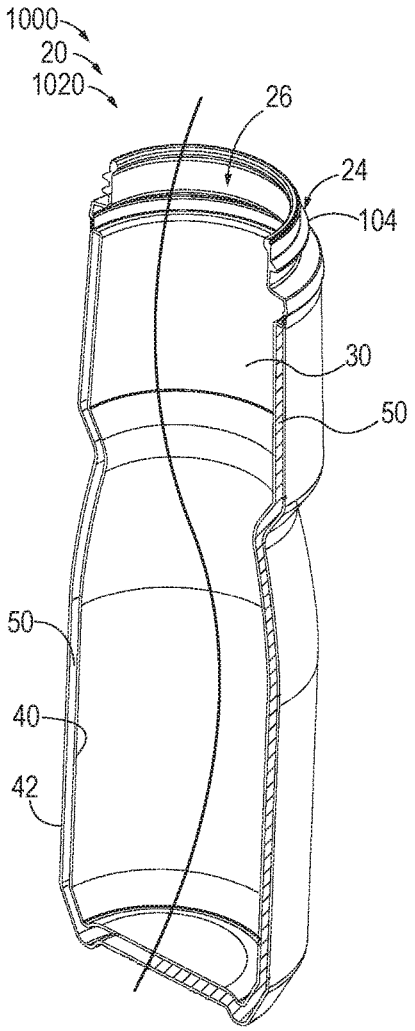
FIG. 16 is a cross-sectional top side isometric view representing examples of liquid vessels with insulation layers according to the present disclosure.
Figure 17:
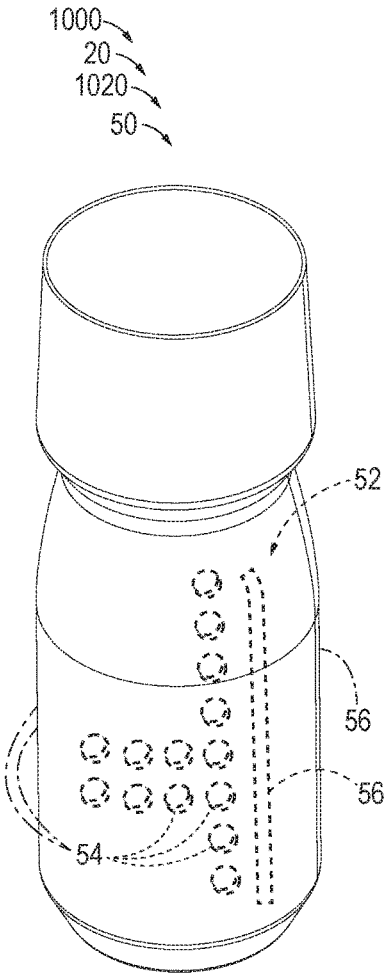
FIG. 17 is a top side isometric view representing examples of insulation layers of the liquid vessels of FIG. 16.

FIG. 16 is a cross-sectional view of examples of liquid vessel 1020 of FIGS. 3-4, and FIG. 17 illustrates examples of insulation layer 50 of liquid vessel 1020. As illustrated on the left-hand side of FIG. 16, liquid vessel 1020 may include insulation layer 50 in the form of a liquid, a gas, and/or a partially evacuated region between inner wall 40 and outer wall 42. Alternatively, and as illustrated on the right-hand side of FIG. 16, insulation layer 50 may include and/or be a solid structure positioned between inner wall 40 and outer wall 42.

FIG. 17 illustrates examples of insulation layers 50 of liquid vessel 1020 in the form of a solid structure and that include liquid level indicator 52. As schematically illustrated in FIG. 17, liquid level indicator 52 of insulation layer 50 may include and/or be a plurality of liquid level indicator features 54, which may take the form of holes and/or apertures defined in the insulation layer. When present, and as schematically illustrated in FIG. 17, the plurality of liquid level indicator features 54 may be distributed about a longitudinal and/or azimuthal (i.e., circumferential) extent of insulation layer 50. Additionally or alternatively, and as further schematically illustrated in FIG. 17, liquid level indicator 52 may include and/or be liquid level indicator strip 56, which may take the form of a slit and/or cutout defined along a longitudinal extent of insulation layer 50. As illustrated schematically in dash-dot lines in FIG. 17, insulation layer 50 may include a plurality of liquid level indicator features 54 and/or liquid level indicator strips 56 positioned on opposite sides of the insulation layer, such as to permit light to pass through the insulation layer and/or internal compartment 30 of liquid vessel 20 via each of the circumferentially opposed sides.

Examples of closure assemblies, liquid vessels, and drink containers according to the present disclosure are presented in the following enumerated paragraphs.

A1. A closure assembly for a drink container that includes a liquid vessel having a neck with an opening and having an internal compartment configured to hold a volume of potable drink liquid, the closure assembly comprising:

a closure base configured to be selectively coupled to the neck of the liquid vessel to selectively couple the closure assembly to the liquid vessel, wherein the closure base defines:

- a base interior side that faces toward the internal compartment when the closure assembly is operatively coupled to the liquid vessel;
- a base exterior side that faces away from the internal compartment when the closure assembly is operatively coupled to the liquid vessel; and
- a closure base passage that extends between and fluidly connects the base interior side and the base exterior side;

a valve insert operatively received within the closure base passage; wherein the valve insert includes a liquid inlet configured to receive the potable drink liquid and a liquid outlet configured to dispense the potable drink liquid; wherein the valve insert extends through the closure base passage when the valve insert is operatively received within the closure base passage; wherein the valve insert is configured to be selectively and repeatedly received within and removed from the closure base passage; wherein the valve insert is configured to be selectively rotated relative to the closure base about a rotational axis to transition the closure assembly between a closed configuration and a drink configuration when the valve insert is operatively received within the closure base passage; wherein in the drink configuration, the valve insert permits flow of the potable drink liquid from the internal compartment through the liquid inlet and to the liquid outlet; and wherein in the closed configuration, the valve insert restricts flow of the potable drink liquid from the internal compartment through the liquid inlet and to the liquid outlet; and a valve insert retainer configured to be selectively and repeatedly coupled to and removed from the valve insert and configured to prevent removal of the valve insert from the closure base when the valve insert is operatively received within the closure base passage and when the valve insert retainer is operatively coupled to the valve insert.

A2. The closure assembly of paragraph A1, wherein the valve insert extends away from the base exterior side of the closure base when the valve insert is operatively received within the closure base passage.

A3. The closure assembly of any of paragraphs A1-A2, wherein the valve insert retainer is operatively coupled to the valve insert on the base interior side of the closure base when the valve insert is operatively received within the closure base passage and when the valve insert retainer is operatively coupled to the valve insert.

A4. The closure assembly of any of paragraphs A1-A3, wherein the valve insert is configured to be selectively and repeatedly received by and removed from the closure base passage only via the base exterior side and only when the valve insert retainer is selectively removed from the valve insert.

A5. The closure assembly of any of paragraphs A1-A4, wherein the closure base includes at least a portion of a closure coupling mechanism configured to selectively couple the closure assembly to the liquid vessel.

A6. The closure assembly of any of paragraphs A1-A5, wherein the closure assembly is at least substantially rotationally symmetric about the rotational axis.

A7. The closure assembly of any of paragraphs A1-A6, wherein the rotational axis is at least substantially parallel to a longitudinal axis of the liquid vessel when the closure base is operatively coupled to the neck of the liquid vessel.

A8. The closure assembly of paragraph A7, wherein the rotational axis is at least substantially collinear with the longitudinal axis of the liquid vessel when the closure base is operatively coupled to the neck of the liquid vessel.

A9. The closure assembly of any of paragraphs A1-A8, wherein the valve insert is configured to be selectively rotated about the rotational axis without concurrently translating along the rotational axis when the valve insert is operatively received within the closure base passage.

A10. The closure assembly of any of paragraphs A1-A9, wherein the valve insert includes a drink spout that extends away from the closure base when the valve insert is operatively received within the closure base passage, and wherein the drink spout at least partially defines the liquid outlet.

A11. The closure assembly of paragraph A10, wherein the drink spout is formed of at least one of a rigid material, a flexible material, a resiliently deformable material, a polymer, a plastic, and silicone.

A12. The closure assembly of any of paragraphs A1-A11, wherein the closure assembly further includes a mouthpiece configured to be selectively and repeatedly attached to and removed from the valve insert.

A13. The closure assembly of paragraph A12, wherein the mouthpiece is configured to be selectively and repeatedly attached to and removed from a/the drink spout of the valve insert.

A14. The closure assembly of any of paragraphs A12-A13, wherein the mouthpiece is formed of at least one of a rigid material, a flexible material, a resiliently deformable material, a polymer, a plastic, and silicone.

A15. The closure assembly of any of paragraphs A1-A14, wherein the valve insert includes a valve passage that fluidly couples the liquid inlet and the liquid outlet.

A16. The closure assembly of any of paragraphs A1-A15, wherein the liquid inlet includes at least one insert port that extends through a sidewall of the valve insert.

A17. The closure assembly of paragraph A16, wherein each insert port includes at least one of a cutout, a notch, a hole, and an aperture defined in the sidewall of the valve insert.

A18. The closure assembly of any of paragraphs A16-A17, wherein, when the valve insert is operatively received within the closure base passage and when the closure assembly is in the drink configuration, the closure assembly permits the potable drink liquid to sequentially enter the valve insert via the at least one insert port, flow through a/the valve passage, and exit the valve insert via the liquid outlet.

A19. The closure assembly of any of paragraphs A16-A18, wherein the valve insert defines a retainer chamber configured to receive at least a portion of the valve insert retainer when the valve insert retainer is operatively coupled to the valve insert, and wherein the valve insert retainer includes a retention plug configured to be selectively inserted into the retainer chamber of the valve insert to couple the valve insert retainer to the valve insert.

A20. The closure assembly of paragraph A19, wherein the retainer chamber is fluidly coupled to the liquid outlet via a/the valve passage.

A21. The closure assembly of any of paragraphs A19-A20, wherein the retainer chamber is fluidly separated from a/the valve passage by a valve insert bulkhead.

A22. The closure assembly of any of paragraphs A1-A21, wherein the closure base passage is at least partially defined by a base sleeve that extends away from the base interior side of the closure base, and wherein the valve insert extends at least partially, and optionally fully, through the base sleeve when the valve insert is operatively received within the closure base passage.

A23. The closure assembly of paragraph A22, when dependent from paragraph A16, wherein each insert port is blocked by the base sleeve to prevent flow of the potable drink liquid from the internal compartment through the liquid inlet and to the liquid outlet when the closure assembly is in the closed configuration and when the valve insert is operatively received within the closure base passage.

A24. The closure assembly of any of paragraphs A22-A23, when dependent from paragraph A16, wherein the base sleeve includes at least one base port, and wherein each insert port is aligned with a corresponding base port when the closure assembly is in the drink configuration to permit flow of the potable drink liquid from the internal compartment through the liquid inlet and to the liquid outlet via each insert port and each corresponding base port.

A25. The closure assembly of paragraph A24, wherein each base port includes at least one of a cutout, a notch, a hole, and an aperture defined in the base sleeve.

A26. The closure assembly of any of paragraphs A24-A25, when dependent from paragraph A16, wherein each insert port is misaligned with each base port when the closure assembly is in the closed configuration.

A27. The closure assembly of any of paragraphs A1-A26, wherein the closure assembly includes an actuator configured to be engaged by a user to selectively transition the closure assembly between the closed configuration and the drink configuration.

A28. The closure assembly of paragraph A27, wherein the actuator includes at least one actuator arm extending radially away from the valve insert on the base exterior side of the closure base.

A29. The closure assembly of paragraph A28, wherein the at least one actuator arm includes one of one actuator arm, two actuator arms, and more than two actuator arms.

A30. The closure assembly of any of paragraphs A27-A29, wherein the actuator is configured to rotate the valve insert with respect to the closure base about the rotational axis of the closure assembly.

A31. The closure assembly of paragraph A30, wherein the actuator is configured to rotate the valve insert without concurrently translating the valve insert along the rotational axis.

A32. The closure assembly of any of paragraphs A27-A31, wherein the actuator prevents removal of the valve insert from the closure base via the base interior side when the valve insert is operatively received within the closure base passage.

A33. The closure assembly of any of paragraphs A22-A32, wherein the base sleeve has a sleeve diameter, wherein the valve insert has a maximum effective insert diameter when the valve insert retainer is operatively coupled to the valve insert, and wherein the maximum effective insert diameter is greater than the sleeve diameter.

A34. The closure assembly of any of paragraphs A1-A33, wherein the valve insert retainer fluidly separates the internal compartment of the liquid vessel and a/the valve passage of the valve insert when the closure assembly is operatively coupled to the liquid vessel and when the closure assembly is in the closed configuration.

A35. The closure assembly of any of paragraphs A1-A34, wherein the valve insert retainer is formed of at least one of a rigid material, a flexible material, a resiliently deformable material, a polymer, a rubber, and silicone.

A36. The closure assembly of paragraph A35, when dependent from paragraph A19, wherein the valve insert includes at least one retention protrusion extending away from the rotational axis, wherein each retention protrusion prevents removal of the valve insert from the closure base when the valve insert is operatively received within the closure base passage and when the retention plug is operatively received within the retainer chamber.

A37. The closure assembly of paragraph A36, wherein each retention protrusion is configured to restrict removal of the valve insert from the closure base when the valve insert is operatively received within the closure base passage and when the retention plug is removed from the retainer chamber.

A38. The closure assembly of any of paragraphs A36-A37, wherein each retention protrusion prevents the valve insert from passing through a/the base sleeve when the retention plug is operatively received within the retainer chamber.

A39. The closure assembly of any of paragraphs A36-A38, wherein each retention protrusion is configured to flex away from the rotational axis of the insert valve to prevent removal of the valve insert from the closure base when the retention plug is operatively received within the retainer chamber.

A40. The closure assembly of any of paragraphs A36-A39, when dependent from paragraph A33, wherein the maximum effective insert diameter is equal to the diameter of a smallest circle that circumscribes the at least one retention protrusion when the retention plug is operatively received within the retainer chamber.

A41. The closure assembly of any of paragraphs A36-A40, wherein each retention protrusion is configured to resiliently flex toward the rotational axis of the insert valve when the retention plug is removed from the retainer chamber to permit the valve insert to be removed from the closure base via the base exterior side of the closure base.

A42. The closure assembly of paragraph A41, wherein each retention protrusion is configured to be flexed manually toward the rotational axis by a user to remove the valve insert from the closure base when the retention plug is removed from the retainer chamber.

A43. The closure assembly of any of paragraphs A41-A42, wherein each retention protrusion is configured to flex toward the rotational axis responsive to engagement with a/the base sleeve as the valve insert is withdrawn from the base sleeve via the base exterior side and when the retention plug is removed from the retainer chamber.

A44. The closure assembly of any of paragraphs A36-A43, when dependent from paragraph A19, wherein the valve insert retainer prevents each retention protrusion from flexing toward the rotational axis of the insert valve when the retention plug is operatively received within the retainer chamber.

A45. The closure assembly of any of paragraphs A1-A44, wherein the valve insert retainer includes a retainer flange that is positioned adjacent to an end of the valve insert and that extends radially outwardly of the valve insert to prevent removal of the valve insert from the closure base when the valve insert is operatively received within the closure base passage and when the valve insert retainer is operatively coupled to the valve insert.

A46. The closure assembly of paragraph A45, when dependent from paragraph A33, wherein the maximum effective insert diameter is equal to the diameter of a smallest circle that circumscribes the retainer flange when the valve insert retainer is operatively coupled to the valve insert.

A47. The closure assembly of any of paragraphs A1-A46, wherein the valve insert retainer includes a retainer skirt configured to extend at least partially around at least one of the valve insert and a/the base sleeve to operatively couple the valve insert retainer to the valve insert.

A48. The closure assembly of paragraph A47, wherein the retainer skirt extends at least partially, and optionally fully, around a circumference of the valve insert when the valve insert retainer is operatively coupled to the valve insert.

A49. The closure assembly of any of paragraphs A47-A48, wherein the retainer skirt is configured to be operatively coupled to the valve insert via a retainer coupling mechanism.

A50. The closure assembly of paragraph A49, wherein the retainer coupling mechanism includes at least one of a friction-fit coupling and a threaded coupling.

A51. The closure assembly of any of paragraphs A1-A50, wherein the closure assembly includes a self-sealing valve positioned within a/the valve passage of the valve insert, wherein the self-sealing valve is configured to permit flow of the potable drink liquid through the valve passage and to the liquid outlet only when a pressure of the potable drink liquid upon the self-sealing valve exceeds a predetermined threshold pressure.

A52. The closure assembly of paragraph A51, wherein the self-sealing valve includes, and optionally is, a slit diaphragm valve.

B1. A drink container, comprising:

a liquid vessel having a neck with an opening and having an internal compartment configured to hold a volume of potable drink liquid; and the closure assembly of any of paragraphs A1-A52 configured to be operatively coupled to the liquid vessel.

B2. The drink container of paragraph B1, wherein the liquid vessel is a semi-rigid liquid vessel configured to be squeezed by a user to expel the potable drink liquid through the closure assembly.

B3. The drink container of paragraph B2, wherein the semi-rigid liquid vessel is configured to permit opposed portions of the liquid vessel to be moved from a nominal configuration toward each other when the liquid vessel is squeezed by a user, and further wherein the liquid vessel automatically returns to the nominal configuration when the opposed portions cease to be squeezed.

B4. The drink container of paragraph B2 or B3, wherein the semi-rigid liquid vessel is resiliently deformable from a nominal configuration to a partially collapsed configuration responsive to a user squeezing opposed portions of the liquid vessel.

B5. The drink container of paragraph B1, wherein the liquid vessel is a rigid liquid vessel.

B6. The drink container of paragraph B1, wherein the liquid vessel is a collapsible liquid vessel that is configured to non-resiliently collapse as liquid is dispensed from the liquid vessel.

B7. The drink container of paragraph B1 or B6, wherein the liquid vessel is a/the collapsible liquid vessel that is configured to deflate as liquid is dispensed from the liquid vessel.

B8. The drink container of any of paragraphs B1-B7, wherein the neck includes at least a portion of a/the closure coupling mechanism configured to selectively couple the closure assembly to the liquid vessel.

B9. The drink container of paragraph B8, wherein the closure coupling mechanism includes threads on the neck and threads on the closure base that matingly engage one another to operatively couple the closure assembly to the liquid vessel.

B10. The drink container of any of paragraphs B1-B9, wherein the liquid vessel includes an inner wall that at least partially defines the internal compartment and an outer wall configured to be gripped by a user.

B11. The drink container of any of paragraphs B1-B10, wherein the liquid vessel includes an insulation layer configured to restrict a transfer of heat energy through the liquid vessel.

B12. The drink container of paragraph B11, wherein the insulation layer includes at least one of a foam, a metallic foil, a fluid, a gas, and a liquid.

B13. The drink container of any of paragraphs B11-B12, wherein the insulation layer is positioned between a/the inner wall and a/the outer wall.

B14. The drink container of any of paragraphs B11-B13, wherein the insulation layer is formed on at least one of a/the inner wall and a/the outer wall.

B15. The drink container of any of paragraphs B11-B13, wherein the insulation layer is adhered to at least one of a/the inner wall and a/the outer wall.

B16. The drink container of any of paragraphs B11-B15, wherein the insulation layer is at least one of optically transparent and optically translucent.

B17. The drink container of any of paragraphs B11-B15, wherein the insulation layer is at least substantially opaque.

B18. The drink container of any of paragraphs B11-B17, wherein the insulation layer includes a liquid level indicator configured to permit visual inspection of the internal compartment when the closure assembly is operatively coupled to the liquid vessel.

B19. The drink container of paragraph B18, wherein the liquid level indicator is configured to permit visual inspection of the volume of the potable drink liquid within the liquid vessel.

B20. The drink container of any of paragraphs B18-B19, wherein the liquid level indicator is at least one of optically transparent and optically translucent.

B21. The drink container of any of paragraphs B18-B20, wherein the liquid level indicator includes a plurality of liquid level indicator features defined in the insulation layer.

B22. The drink container of paragraph B21, wherein each liquid level indicator feature includes an aperture defined by the insulation layer.

B23. The drink container of any of paragraphs B21-B22, wherein the plurality of liquid level indicator features are distributed about a longitudinal extent of the insulation layer to permit visual inspection of each of a plurality of volumes of the potable drink liquid within the liquid vessel.

B24. The drink container of any of paragraphs B21-B23, wherein the plurality of liquid level indicator features are distributed about an azimuthal extent of the insulation layer to facilitate visual inspection of the volume of the potable drink liquid within the liquid vessel from a plurality of viewing angles.

B25. The drink container of any of paragraphs B21-B24, wherein the plurality of liquid level indicator features are positioned on circumferentially opposed sides of the insulation layer.

B26. The drink container of any of paragraphs B21-B25, wherein each liquid level indicator feature has a shape that includes at least one of a circle, an ellipse, a polygon, a triangle, a quadrilateral, a rectangle, and a square.

B27. The drink container of any of paragraphs B21-B26, wherein the liquid level indicator includes at least one liquid level indicator strip extending along a longitudinal extent of the insulation layer.

B28. The drink container of any of paragraphs B21-B27, wherein the insulation layer is at least substantially formed of a material with a thermal insulation that is quantified by a base R-value; wherein the liquid level indicator is configured such that the insulation layer has an average R-value, as measured across a full surface area of the insulation layer; and wherein the average R-value of the insulation layer is at least one of at least 70% of the base R-value, at least 80% of the base R-value, at least 90% of the base R-value, and at least 95% of the base R-value.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein, "selective" and "selectively," when modifying an action, movement, configuration, or other activity of one or more components or characteristics of a drink container according to the present disclosure, means that the specified action, movement, configuration, or other activity is a direct or indirect result of user manipulation of an aspect of, or one or more components of, the drink container.

As used herein, "operative" and "operatively," when modifying an action, movement, configuration, interconnection, coupling, or other relationship of one or more components of a drink container according to the present disclosure, means that the specified action, movement, configuration, interconnection, coupling or other relationship is performed and/or achieved as a result of standard (i.e., intended) operation and/or functional utilization of the one or more components of the drink container, such as in a manner described herein.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

INDUSTRIAL APPLICABILITY

The drink containers disclosed herein are applicable to the beverage container industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, also are regarded as included within the subject matter of the inventions of the present disclosure.

The invention claimed is:

1. A closure assembly for a drink container that includes a liquid vessel having a neck with an opening and having an internal compartment configured to hold a volume of potable drink liquid, the closure assembly comprising:

a closure base configured to be selectively coupled to the neck of the liquid vessel to selectively couple the closure assembly to the liquid vessel, wherein the closure base defines:

a base interior side that faces toward the internal compartment when the closure assembly is operatively coupled to the liquid vessel;

a base exterior side that faces away from the internal compartment when the closure assembly is operatively coupled to the liquid vessel; and a closure base passage that extends between and fluidly connects the base interior side and the base exterior side;

a valve insert operatively received within the closure base passage; wherein the valve insert includes a liquid inlet configured to receive the potable drink liquid and a liquid outlet configured to dispense the potable drink liquid; wherein the valve insert extends through the closure base passage when the valve insert is operatively received within the closure base passage; wherein the valve insert is configured to be selectively and repeatedly received within and removed from the closure base passage; wherein the valve insert is configured to be selectively rotated relative to the closure base about a rotational axis to transition the closure assembly between a closed configuration and a drink configuration when the valve insert is operatively received within the closure base passage; wherein in the drink configuration, the valve insert permits flow of the potable drink liquid from the internal compartment through the liquid inlet and to the liquid outlet; and wherein in the closed configuration, the valve insert restricts flow of the potable drink liquid from the internal compartment through the liquid inlet and to the liquid outlet; and a valve insert retainer configured to be selectively and repeatedly coupled to and removed from the valve insert and configured to prevent removal of the valve insert from the closure base when the valve insert is operatively received within the closure base passage and when the valve insert retainer is operatively coupled to the valve insert;

wherein the valve insert retainer is operatively coupled to the valve insert on the base interior side of the closure base when the valve insert is operatively received within the closure base passage and when the valve insert retainer is operatively coupled to the valve insert;

wherein the valve insert is configured to be selectively and repeatedly received by and removed from the closure base passage only via the base exterior side and only when the valve insert retainer is selectively removed from the valve insert; and wherein the valve insert is configured to be selectively rotated about the rotational axis without concurrently translating along the rotational axis when the valve insert is operatively received within the closure base passage.

2. The closure assembly of claim 1, wherein the valve insert includes a valve passage that fluidly couples the liquid inlet and the liquid outlet; wherein the liquid inlet includes at least one insert port that extends through a sidewall of the valve insert; and wherein, when the valve insert is operatively received within the closure base passage and when the closure assembly is in the drink configuration, the closure assembly permits the potable drink liquid to sequentially enter the valve insert via the at least one insert port, flow through the valve passage, and exit the valve insert via the liquid outlet.

3. The closure assembly of claim 2, wherein the closure base passage is at least partially defined by a base sleeve that extends away from the base interior side of the closure base; wherein the valve insert extends at least partially through the base sleeve when the valve insert is operatively received within the closure base passage; wherein each insert port is blocked by the base sleeve when the closure assembly is in the closed configuration to restrict flow of the potable drink liquid from the internal compartment through the liquid inlet and to the liquid outlet; wherein the base sleeve includes at least one base port; and wherein each insert port is aligned with a corresponding base port when the closure assembly is in the drink configuration to permit flow of the potable drink liquid from the internal compartment through the liquid inlet and to the liquid outlet via each insert port and each corresponding base port.

4. The closure assembly of claim 3, wherein each base port includes at least one of a cutout, a notch, a hole, and an aperture defined in the base sleeve; and wherein each insert port is misaligned with each base port when the closure assembly is in the closed configuration.

5. The closure assembly of claim 3, wherein the base sleeve has a sleeve diameter, wherein the valve insert has a maximum effective insert diameter when the valve insert retainer is operatively coupled to the valve insert, and wherein the maximum effective insert diameter is greater than the sleeve diameter.

6. The closure assembly of claim 1, wherein the valve insert defines a retainer chamber configured to receive at least a portion of the valve insert retainer when the valve insert retainer is operatively coupled to the valve insert, and wherein the valve insert retainer includes a retention plug configured to be selectively inserted into the retainer chamber of the valve insert to prevent removal of the valve insert from the closure base.

7. The closure assembly of claim 6, wherein the valve insert includes at least one retention protrusion extending away from the rotational axis, wherein each retention protrusion is configured to prevent removal of the valve insert from the closure base when the valve insert is operatively received within the closure base passage and when the retention plug is operatively received within the retainer chamber.

8. The closure assembly of claim 7, wherein each retention protrusion is configured to restrict removal of the valve insert from the closure base when the valve insert is operatively received within the closure base passage and when the retention plug is removed from the retainer chamber.

9. The closure assembly of claim 7, wherein each retention protrusion is configured to flex away from the rotational axis of the valve insert to prevent removal of the valve insert from the closure base when the retention plug is operatively received within the retainer chamber.

10. The closure assembly of claim 7, wherein each retention protrusion is configured to resiliently flex toward the rotational axis of the valve insert when the retention plug is removed from the retainer chamber to permit the valve insert to be removed from the closure base from the base exterior side of the closure base.

11. The closure assembly of claim 6, wherein the retainer chamber is fluidly coupled to the liquid outlet via a valve passage that fluidly couples the liquid inlet and the liquid outlet.

12. The closure assembly of claim 1, wherein the closure assembly includes an actuator configured to be engaged by a user to selectively transition the closure assembly between the closed configuration and the drink configuration; and wherein the actuator includes at least one actuator arm extending radially away from the valve insert on the base exterior side of the closure base.

13. The closure assembly of claim 1, wherein the valve insert includes a drink spout that extends away from the closure base when the valve insert is operatively received within the closure base passage, and wherein the drink spout at least partially defines the liquid outlet.

14. A drink container, comprising:

a liquid vessel having a neck with an opening and having an internal compartment configured to hold a volume of potable drink liquid; and the closure assembly of claim 1 configured to be operatively coupled to the liquid vessel; and wherein the liquid vessel is a semi-rigid liquid vessel configured to be squeezed by a user to expel the potable drink liquid through the closure assembly.

15. The drink container of claim 14, wherein the liquid vessel includes an inner wall that at least partially defines the internal compartment and an outer wall configured to be gripped by a user; and wherein the liquid vessel includes an insulation layer configured to restrict a transfer of heat energy through the liquid vessel.

16. The drink container of claim 15, wherein the insulation layer includes at least one of a foam and a metallic foil.

17. The drink container of claim 15, wherein the insulation layer includes a liquid level indicator configured to permit visual inspection of the internal compartment when the closure assembly is operatively coupled to the liquid vessel.

18. A closure assembly for a drink container that includes a liquid vessel having a neck with an opening and having an internal compartment configured to hold a volume of potable drink liquid, the closure assembly comprising:

a closure base configured to be selectively coupled to the neck of the liquid vessel to selectively couple the closure assembly to the liquid vessel, wherein the closure base defines:

a base interior side that faces toward the internal compartment when the closure assembly is operatively coupled to the liquid vessel;

a base exterior side that faces away from the internal compartment when the closure assembly is operatively coupled to the liquid vessel; and a closure base passage that extends between and fluidly connects the base interior side and the base exterior side;

a valve insert operatively received within the closure base passage; wherein the valve insert includes a liquid inlet configured to receive the potable drink liquid and a liquid outlet configured to dispense the potable drink liquid; wherein the valve insert extends through the closure base passage when the valve insert is operatively received within the closure base passage; wherein the valve insert is configured to be selectively and repeatedly received within and removed from the closure base passage; wherein the valve insert is configured to be selectively rotated relative to the closure base about a rotational axis to transition the closure assembly between a closed configuration and a drink configuration when the valve insert is operatively received within the closure base passage; wherein in the drink configuration, the valve insert permits flow of the potable drink liquid from the internal compartment through the liquid inlet and to the liquid outlet; and wherein in the closed configuration, the valve insert restricts flow of the potable drink liquid from the internal compartment through the liquid inlet and to the liquid outlet; and a valve insert retainer configured to be selectively and repeatedly coupled to and removed from the valve insert and configured to prevent removal of the valve insert from the closure base when the valve insert is operatively received within the closure base passage and when the valve insert retainer is operatively coupled to the valve insert;

wherein the valve insert retainer is operatively coupled to the valve insert on the base interior side of the closure base when the valve insert is operatively received within the closure base passage and when the valve insert retainer is operatively coupled to the valve insert;

wherein the valve insert is configured to be selectively and repeatedly received by and removed from the closure base passage only via the base exterior side and only when the valve insert retainer is selectively removed from the valve insert;

wherein the valve insert includes a valve passage that fluidly couples the liquid inlet and the liquid outlet; wherein the liquid inlet includes at least one insert port that extends through a sidewall of the valve insert;

wherein, when the valve insert is operatively received within the closure base passage and when the closure assembly is in the drink configuration, the closure assembly permits the potable drink liquid to sequentially enter the valve insert via the at least one insert port, flow through the valve passage, and exit the valve insert via the liquid outlet;

wherein the closure base passage is at least partially defined by a base sleeve that extends away from the base interior side of the closure base;

wherein the valve insert extends at least partially through the base sleeve when the valve insert is operatively received within the closure base passage;

wherein each insert port is blocked by the base sleeve when the closure assembly is in the closed configuration to restrict flow of the potable drink liquid from the internal compartment through the liquid inlet and to the liquid outlet; and wherein the base sleeve includes at least one base port; and wherein each insert port is aligned with a corresponding base port when the closure assembly is in the drink configuration to permit flow of the potable drink liquid from the internal compartment through the liquid inlet and to the liquid outlet via each insert port and each corresponding base port.

19. The closure assembly of claim 18, wherein each base port includes at least one of a cutout, a notch, a hole, and an aperture defined in the base sleeve.

20. The closure assembly of claim 18, wherein each insert port is misaligned with each base port when the closure assembly is in the closed configuration.

21. The closure assembly of claim 18, wherein the base sleeve has a sleeve diameter, wherein the valve insert has a maximum effective insert diameter when the valve insert retainer is operatively coupled to the valve insert, and wherein the maximum effective insert diameter is greater than the sleeve diameter.

22. The closure assembly of claim 18, wherein the closure assembly includes an actuator configured to be engaged by a user to selectively transition the closure assembly between the closed configuration and the drink configuration; wherein the actuator includes at least one actuator arm extending radially away from the valve insert on the base exterior side of the closure base; wherein the valve insert includes a drink spout that extends away from the closure base when the valve insert is operatively received within the closure base passage, and wherein the drink spout at least partially defines the liquid outlet.

23. A drink container, comprising:

a liquid vessel having a neck with an opening and having an internal compartment configured to hold a volume of potable drink liquid; and the closure assembly of claim 18 configured to be operatively coupled to the liquid vessel; wherein the liquid vessel is a semi-rigid liquid vessel configured to be squeezed by a user to expel the potable drink liquid through the closure assembly.

24. The drink container of claim 23, wherein the liquid vessel includes an inner wall that at least partially defines the internal compartment and an outer wall configured to be gripped by a user; and wherein the liquid vessel includes an insulation layer configured to restrict a transfer of heat energy through the liquid vessel.

25. The drink container of claim 24, wherein the insulation layer at least substantially includes a liquid level indicator configured to permit visual inspection of the internal compartment when the closure assembly is operatively coupled to the liquid vessel.

26. A closure assembly for a drink container that includes a liquid vessel having a neck with an opening and having an internal compartment configured to hold a volume of potable drink liquid, the closure assembly comprising:

a closure base configured to be selectively coupled to the neck of the liquid vessel to selectively couple the closure assembly to the liquid vessel, wherein the closure base defines:

a base interior side that faces toward the internal compartment when the closure assembly is operatively coupled to the liquid vessel;

a base exterior side that faces away from the internal compartment when the closure assembly is operatively coupled to the liquid vessel; and a closure base passage that extends between and fluidly connects the base interior side and the base exterior side;

a valve insert operatively received within the closure base passage; wherein the valve insert includes a liquid inlet configured to receive the potable drink liquid and a liquid outlet configured to dispense the potable drink liquid; wherein the valve insert extends through the closure base passage when the valve insert is operatively received within the closure base passage; wherein the valve insert is configured to be selectively and repeatedly received within and removed from the closure base passage; wherein the valve insert is configured to be selectively rotated relative to the closure base about a rotational axis to transition the closure assembly between a closed configuration and a drink configuration when the valve insert is operatively received within the closure base passage; wherein in the drink configuration, the valve insert permits flow of the potable drink liquid from the internal compartment through the liquid inlet and to the liquid outlet; and wherein in the closed configuration, the valve insert restricts flow of the potable drink liquid from the internal compartment through the liquid inlet and to the liquid outlet; and a valve insert retainer configured to be selectively and repeatedly coupled to and removed from the valve insert and configured to prevent removal of the valve insert from the closure base when the valve insert is operatively received within the closure base passage and when the valve insert retainer is operatively coupled to the valve insert;

wherein the valve insert retainer is operatively coupled to the valve insert on the base interior side of the closure base when the valve insert is operatively received within the closure base passage and when the valve insert retainer is operatively coupled to the valve insert;

wherein the valve insert defines a retainer chamber configured to receive at least a portion of the valve insert retainer when the valve insert retainer is operatively coupled to the valve insert; and wherein the valve insert retainer includes a retention plug configured to be selectively inserted into the retainer chamber of the valve insert to prevent removal of the valve insert from the closure base.

27. The closure assembly of claim 26, wherein the valve insert includes at least one retention protrusion extending away from the rotational axis, wherein each retention protrusion is configured to prevent removal of the valve insert from the closure base when the valve insert is operatively received within the closure base passage and when the retention plug is operatively received within the retainer chamber.

28. The closure assembly of claim 27, wherein each retention protrusion is configured to restrict removal of the valve insert from the closure base when the valve insert is operatively received within the closure base passage and when the retention plug is removed from the retainer chamber.

29. The closure assembly of claim 28, wherein each retention protrusion is configured to flex away from the rotational axis of the valve insert to prevent removal of the valve insert from the closure base when the retention plug is operatively received within the retainer chamber.

30. The closure assembly of claim 28, wherein each retention protrusion is configured to resiliently flex toward the rotational axis of the valve insert when the retention plug is removed from the retainer chamber to permit the valve insert to be removed from the closure base from the base exterior side of the closure base.

31. The closure assembly of claim 26, wherein the retainer chamber is fluidly coupled to the liquid outlet via a valve passage that fluidly couples the liquid inlet and the liquid outlet.

32. The closure assembly of claim 26, wherein the closure assembly includes an actuator configured to be engaged by a user to selectively transition the closure assembly between the closed configuration and the drink configuration; wherein the actuator includes at least one actuator arm extending radially away from the valve insert on the base exterior side of the closure base; wherein the valve insert includes a drink spout that extends away from the closure base when the valve insert is operatively received within the closure base passage, and wherein the drink spout at least partially defines the liquid outlet.

33. A drink container, comprising:

a liquid vessel having a neck with an opening and having an internal compartment configured to hold a volume of potable drink liquid; and the closure assembly of claim 26 configured to be operatively coupled to the liquid vessel; wherein the liquid vessel is a semi-rigid liquid vessel configured to be squeezed by a user to expel the potable drink liquid through the closure assembly.

34. The drink container of claim 33, wherein the liquid vessel includes an inner wall that at least partially defines the internal compartment and an outer wall configured to be gripped by a user; and wherein the liquid vessel includes an insulation layer configured to restrict a transfer of heat energy through the liquid vessel.

35. The drink container of claim 34, wherein the insulation layer includes a liquid level indicator configured to permit visual inspection of the internal compartment when the closure assembly is operatively coupled to the liquid vessel.

* * * * *